US007661783B2

(12) United States Patent
Hibi et al.

(10) Patent No.: US 7,661,783 B2
(45) Date of Patent: Feb. 16, 2010

(54) INKJET RECORDING APPARATUS AND CONTROL METHOD FOR THE SAME

(75) Inventors: Manabu Hibi, Nagoya (JP); Kenichi Satake, Kirishima (JP); Shin Ishikura, Kirishima (JP)

(73) Assignees: Brother Kogyo Kabushiki Kaisha, Nagoya-shi, Aichi-ken (JP); Kyocera Corporation, Kyoto-shi, Kyoto-fu (JP)

( * ) Notice: Subject to any disclaimer, the term of this patent is extended or adjusted under 35 U.S.C. 154(b) by 188 days.

(21) Appl. No.: 11/538,832

(22) Filed: Oct. 5, 2006

(65) Prior Publication Data

US 2007/0081050 A1 Apr. 12, 2007

(30) Foreign Application Priority Data

Oct. 6, 2005 (JP) ..... 2005-293862

(51) Int. Cl.
*B41J 29/38* (2006.01)

(52) U.S. Cl. ..... 347/10; 347/11; 347/70

(58) Field of Classification Search ..... 347/9, 347/10, 11, 12, 68
See application file for complete search history.

(56) References Cited

U.S. PATENT DOCUMENTS 6,095,630 A * 8/2000 Horii et al. ..... 347/10
6,099,103 A 8/2000 Takahashi
6,350,003 B1 2/2002 Ishikawa
6,808,254 B2 10/2004 Sakaida et al.
6,913,349 B2 7/2005 Hirota
6,953,241 B2 10/2005 Sakaida et al.
6,984,027 B2 1/2006 Sakaida et al.
6,986,565 B2 1/2006 Watanabe et al.
7,014,294 B2 3/2006 Sakaida et al.
2004/0189752 A1 * 9/2004 Satake ..... 347/68

(Continued)

FOREIGN PATENT DOCUMENTS

EP 1123806 A1 8/2001

(Continued)

OTHER PUBLICATIONS

Chinese Office Action issued in corresponding Chinese Application No. 2006-101421179, dated May 16, 2008.

(Continued)

*Primary Examiner*—Lam S Nguyen
(74) *Attorney, Agent, or Firm*—Baker Botts, LLP.

(57) ABSTRACT

A controller controls a pressurizing actuator in such a manner that a pressure chamber changes from a first state where a volume of the pressure chamber is V1 to a second state where the volume is V2 larger than V1 and then returns from the second to the first state to cause ink to be ejected from an ejection opening, that a time length $Tv_1$ from a time point at which the pressure chamber starts to change from the first to the second state to a time point at which the pressure chamber is in the second state becomes 33% or more of a characteristic vibration period Td of ink filled in a first ink passage extending from an outlet of the pressure chamber to the ejection opening, and that the time length $Tv_1$ becomes 83% or less of the characteristic vibration period Td.

8 Claims, 14 Drawing Sheets

U.S. PATENT DOCUMENTS

2005/0231554 A1 10/2005 Sakaida et al.

FOREIGN PATENT DOCUMENTS

EP 1378358 A1 1/2004
EP 1403047 A1 3/2004
EP 1403047 B1 12/2005
EP 1661704 A1 5/2006
JP 2003305852 A 10/2003

OTHER PUBLICATIONS

European Patent Office, European Search Report for Related EP Application No. 06020961 dated Jun. 4, 2008.

* cited by examiner

INKJET RECORDING APPARATUS AND CONTROL METHOD FOR THE SAME

BACKGROUND OF THE INVENTION

1. Field of the Invention

This invention relates to an inkjet recording apparatus and a method for controlling the inkjet recording apparatus.

2. Description of the Related Art

In some of inkjet recording apparatuses for performing printing by the inkjet method, ink is ejected from a nozzle when pressure is applied to ink contained in a pressure chamber. Among those apparatuses, an inkjet recording apparatus employing a so-called fill before fire method is disclosed in JP-A-2003-305852, which is capable of applying pressure to ink by temporarily increasing a volume of a pressure chamber and returning the volume of the pressure chamber to the original volume after an elapse of a predetermined time period.

SUMMARY OF THE INVENTION

In the case of employing the fill before fire method, the time period from the increase in volume of the pressure chamber to the return to the original volume, which corresponds to a pulse width To described later, is adjusted to the Acoustic Length (AL), a time length that causes the ink to be ejected from the nozzle at a maximum speed. However, in the case where the time period is set to values other than the AL, the ink ejection speed sometimes becomes a local maximal value or a local minimal value which are different from the maximum value (see the curve C2 in FIG. 9). For example, when the time period is set to a certain local minimal value, an ejected ink droplet is broken up to become high speed small droplets. In such case, a noise or the like is generated on a printed image. In the case where the time period is set to a certain local maximal value, the influence of the change in pressure applied to ink upon the ink ejection speed is enhanced so as to cause a large increase in the ink ejection speed. In such case, the variation in ink ejection speed with respect to the variation in pressure applied to ink is increased.

When a noise arises or the ink ejection speed is varied, as described above, reproducibility of an image formed by the ejected ink is deteriorated.

An object of this invention is to provide an inkjet recording apparatus and a method for controlling the inkjet recording apparatus, which produce excellent image reproducibility without causing a noise and variation in the ink ejection speed.

According to one aspect of this invention, an inkjet recording apparatus including a pressurizing actuator, a passage unit, and a controller is provided. In the passage unit, a pressure chamber whose volume is changed by the pressurizing actuator and an ejection opening for ejecting ink are formed. The passage unit has a first ink passage which extends from an outlet of the pressure chamber to the ejection opening. The controller controls the pressurizing actuator in such a manner that the pressure chamber changes from a first state where a volume of the pressure chamber is V1 to a second state where the volume is V2 which is larger than V1 and then returns from the second state to the first state to cause ink to be ejected from the ejection opening, that a time length $Tv_1$ from a time point at which the pressure chamber starts to change from the first state to the second state to a time point at which the pressure chamber is in the second state becomes 33% or more of a characteristic vibration period Td of ink filled in the first ink passage, and that the time length $Tv_1$ becomes 83% or less of the characteristic vibration period Td.

According to another aspect of this invention, a method for controlling an inkjet recording apparatus is provided. The inkjet recording apparatus includes a pressurizing actuator and a passage unit. In the passage unit, a pressure chamber whose volume is changed by the pressurizing actuator and an ejection opening for ejecting ink are formed. The passage unit has a first ink passage which extends from an outlet of the pressure chamber to the ejection opening. The method has a step of controlling the pressurizing actuator in such a manner that the pressure chamber changes from a first state where a volume of the pressure chamber is V1 to a second state where the volume is V2 which is larger than V1 and then returns from the second state to the first state to cause ink to be ejected from the ejection opening, that a time length $Tv_1$ from a time point at which the pressure chamber starts to change from the first state to the second state to a time point at which the pressure chamber is in the second state becomes 33% or more of a characteristic vibration period Td of ink filled in the first ink passage, and that the time length $Tv_1$ becomes 83% or less of the characteristic vibration period Td.

According to the above aspects, as understood from analysis results described later, since an ink ejection speed does not become an extreme value shown in a range 91 of FIG. 11, i.e., the extreme value shown in the curve C2 of FIG. 9 described above, the problem of deterioration in image reproducibility due to the noise or the variation in ink ejection speed is suppressed. It is considered that such effect is attributable to the following causes. That is, as $Tv_1$ is increased to a certain value, change in pressure applied by the pressurizing actuator to ink in the pressure chamber is moderated. Thus, a pressure wave that can cause a characteristic vibration seldom or never arises in ink filled in a first ink passage, thereby suppressing excitation of the characteristic vibration.

BRIEF DESCRIPTION OF THE DRAWINGS

Other and further objects, features, and advantages of the invention will appear more fully from the following description taken in connection with the accompanying drawings in which.

DESCRIPTION OF THE PREFERRED EMBODIMENTS

Hereinafter, preferred embodiments of this invention and analysis results obtained by the inventors of this invention will be described with reference to the drawings.

Figure 1:
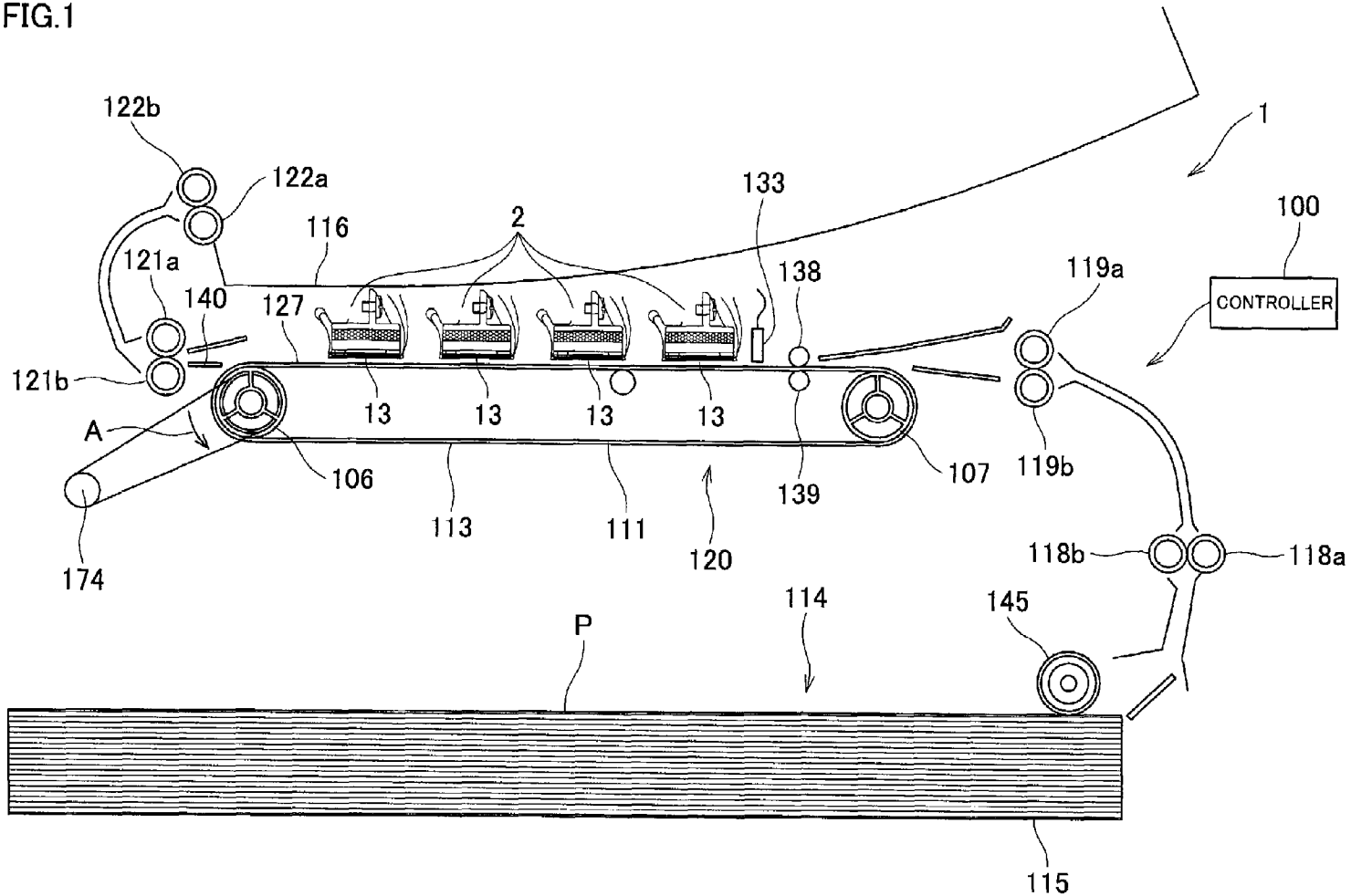
FIG. 1 is a schematic block diagram showing an inkjet printer according to one embodiment of this invention.

FIG. 1 is a schematic diagram showing a color inkjet printer according to one embodiment of this invention. A color inkjet printer 1, hereinafter referred to as printer 1, has four inkjet heads 2. The inkjet heads 2 are aligned along a conveyance direction for a printing paper P and fixed to the printer 1. Each of the inkjet heads 2 has an elongated shape extending along a vertical direction of FIG. 1.

The printer 1 is provided with a feed unit 114, a conveyance unit 120, and a printed paper receiver 116 which are aligned in this order along a conveyance path for the printing paper P. The printer 1 is provided with a controller 100 for controlling operations of components of the printer 1, such as the inkjet heads 2 and the feed unit 114.

The feed unit 114 has a paper housing case 115 capable of housing the printing papers P and a feed roller 145. The feed roller 145 is capable of feeding one placed on the top of printing papers P accumulated in the paper housing case 115 so that the printing papers P are fed one by one.

Between the feed unit 114 and the conveyance unit 120, a pair of feed rollers 118*a* and 118*b* and a pair of feed rollers 119*a* and 119*b* are disposed along a conveyance path of the printing paper P. The printing paper P fed from the feed unit 114 is guided by the rollers 118*a*, 118*b*, 119*a*, and 119*b* to be passed to the conveyance unit 120.

The conveyance unit 120 has an endless conveyance belt 111 and two belt rollers 106 and 107. The conveyance belt 111 is wound around the belt rollers 106 and 107. The conveyance belt 111 has a length that is so adjusted that the conveyance belt 111 is stretched with a predetermined tension when wound around the two belt rollers 106 and 107. Thus, the conveyance belt 111 is stretched along two parallel flat surfaces each of which includes a common tangent line of the two belt rollers 106 and 107 without slack. Of the two flat surfaces, the one closer to the inkjet heads 2 is a conveyor face 127 for the printing paper P.

As shown in FIG. 1, a conveyance motor 174 is connected to the belt roller 106. The conveyance motor 174 rotates the belt roller 106 in a direction of an arrow A so that the belt roller 107 is rotated relative to the conveyance belt 111. Thus, when the belt roller 106 is rotated by driving the conveyance motor 174, the conveyance belt 111 moves along the direction of the arrow A.

In the vicinity of the belt roller 107, a pair of nip rollers 138 and 139 is disposed to sandwich the conveyance belt 111. The upper nip roller 138 is biased downward by a spring (not shown). The lower roller 139 receives the nip roller 138 biased downward via the conveyance belt 111. The pair of nip rollers 138 and 139 is rotatably disposed and rotates in conjunction with the movement of the conveyance belt 111.

The printing paper P fed from the feed unit 114 to the conveyance unit 120 is sandwiched between the nip roller 138 and the conveyance belt 111. Thus, the printing paper P is pressed against the conveyor face 127 of the conveyance belt 111 to be fixed on the conveyor face 127. Then, the printing paper P is conveyed to a position at which the inkjet heads 2 are disposed in accordance with the rotation of the conveyance belt 111. An adhesive silicon rubber treatment may be performed on an outer periphery of the conveyance belt 111 so as to fix the printing paper P to the conveyor face 127 without fail.

The four inkjet heads 2 are disposed along the conveyance direction for the printing paper P and close to one another. Each of the inkjet heads 2 has a head main body 13 at its lower end. Many nozzles 8 for ejecting ink are provided on a bottom face of the head main body 13 (see FIGS. 3 and 4). From the nozzles 8 provided in one inkjet head 2, ink of an identical color is ejected. Colors of the ink ejected from the inkjet heads 2 are magenta (M), yellow (Y), cyan (C), and black (K). Each of the inkjet heads 2 is disposed with a slight gap being defined between the bottom face of the head main body 13 and the conveyor face 127 of the conveyance belt 111.

The printing paper P conveyed by the conveyance belt 111 passes through the gap between the inkjet heads 2 and the conveyance belt 111. When passing though the gap, ink is ejected toward a top face of the printing paper P from the head main bodies 13. Thus, a color image based on image data stored by the controller 100 is formed on the top face of the printing paper P.

Between the conveyance unit 120 and the printed paper receiver 116, a peeling plate 140, a pair of feed rollers 121*a* and 121*b*, and a pair of feed rollers 122*a* and 122*b* are disposed. The paper P on which the color image has been printed is conveyed to the peeling plate 140 by the conveyance belt 111. Then, the paper P is peeled apart from the conveyor face 127 by a right end of the peeling plate 140. The paper P is then fed to the printed paper receiver 116 by the feed rollers 121*a*, 121*b*, 122*a*, and 122*b*. Printed papers P are sequentially fed to the printed paper receiver 116 to be accumulated on the printed paper receiver 116.

Between the inkjet heads 2 and the nip roller 138 which are disposed at the most upstream part in the conveyance direction for the printing paper P, a paper sensor 133 is provided. The paper sensor 133 includes a light emission element and light receiving element and detects a leading end of the printing paper P on the conveyance path. A detection result of the paper sensor 133 is sent to the controller 100. The controller 100 controls the inkjet heads 2, the conveyance motor 174, and the like based on the detection result sent from the paper sensor 133 in such a manner as to synchronize the conveyance of the printing paper P with the image printing.

Figure 2:
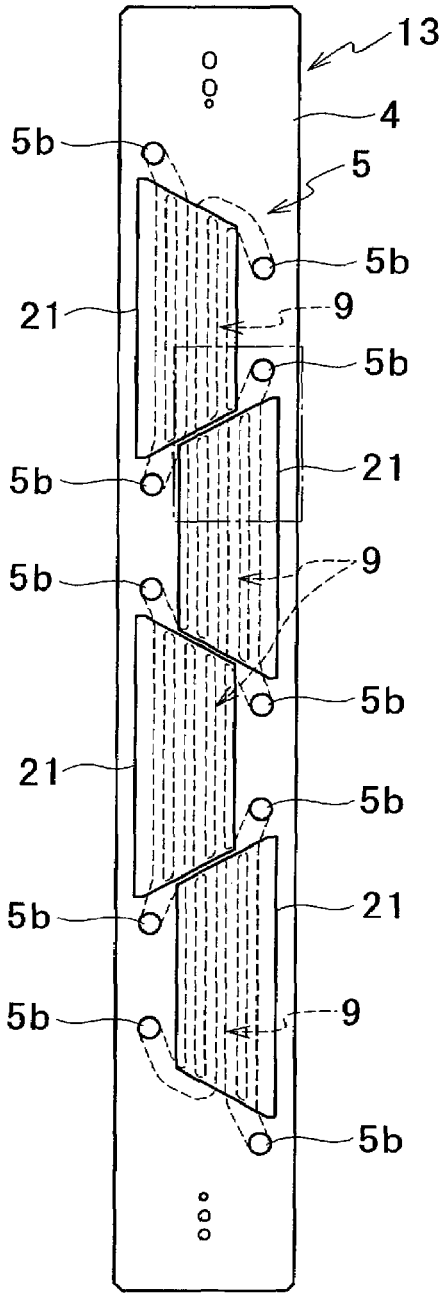
FIG. 2 is a top view of a head main body shown in FIG. 1.

Hereinafter, the head main body 13 will be described. FIG. 2 is a top view showing the head main body 13 shown in FIG. 1.

The head main body 13 has a passage unit 4 and actuator units 21 attached to the passage unit 4. Each of the actuator units 21 has a trapezoidal shape and is disposed on a top face of the passage unit 4 in such a fashion that a pair of parallel sides of the trapezoid is parallel to a longitudinal direction of the passage unit 4. The actuator units 21 are disposed in such a fashion that two actuator units 21 are disposed along each of two straight lines that are parallel to the longitudinal direction of the passage unit 4, i.e., the four actuator units 21 are arranged in zigzag alignment on the passage unit 4. Orthogonal sides of the adjacent actuator units 21 on the passage unit 4 partially overlap with each other with respect to a width direction of the passage unit 4.

A manifold channel 5 is formed inside the passage unit 4. On the top face of the passage unit 4, openings 5*b* of the manifold channel 5 are formed. Five openings 5*b* are formed along each of the two straight lines which are parallel to the longitudinal direction of the passage unit 4, i.e., ten openings 5*b* are formed on the passage unit 4. The openings 5*b* are formed at positions avoiding regions on which the four actuator units 21 are formed. Ink is supplied from an ink tank (not shown) to the manifold channel 5 through the openings 5*b*.

Figure 3:
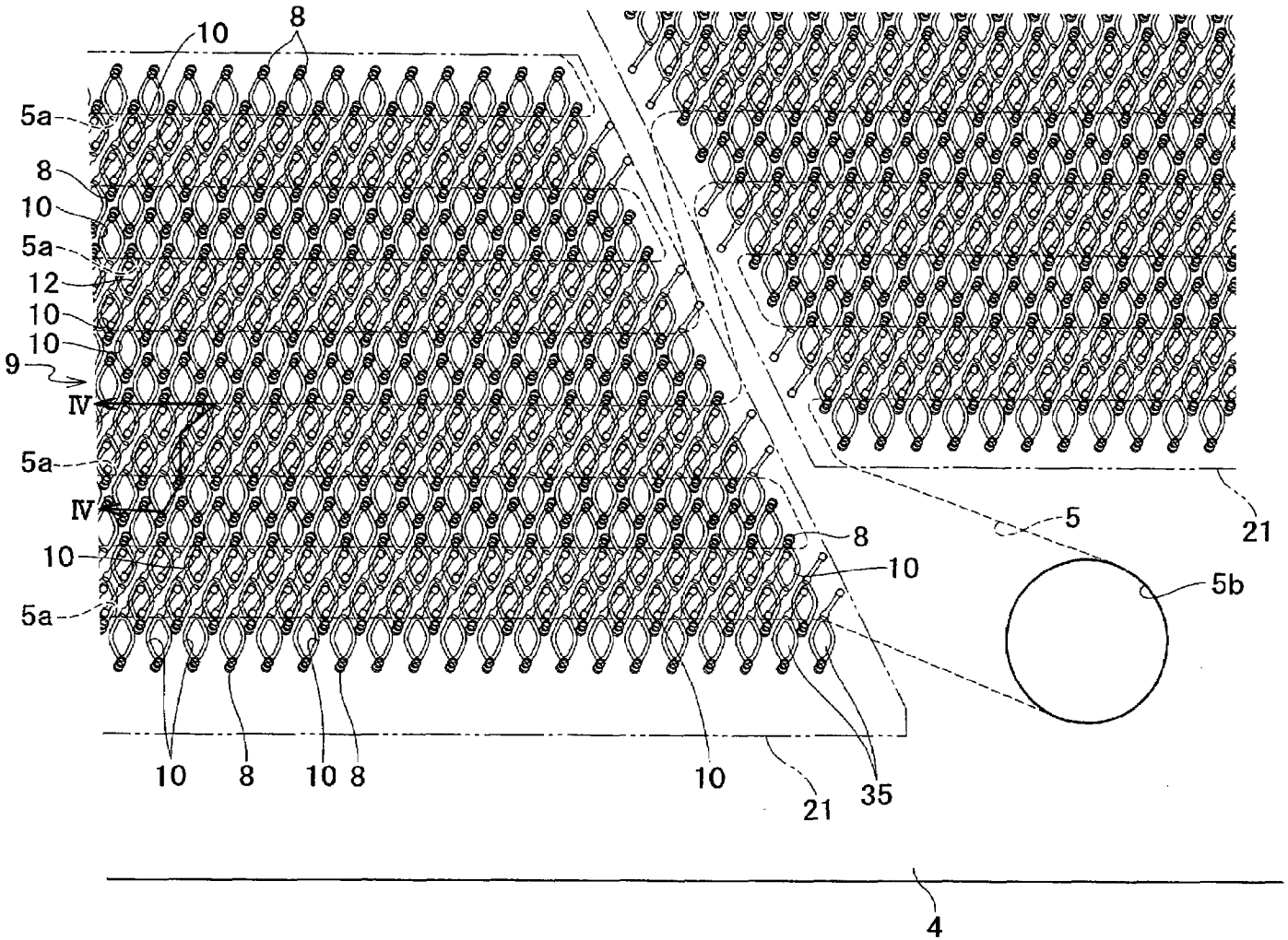
FIG. 3 is an enlarged view showing the region enclosed by the chain line of FIG. 2.

FIG. 3 is an enlarged top view showing the region enclosed by a chain line in FIG. 2. For the convenience of description, the actuator units 21 are indicated by a two dot chain line in FIG. 3. Though apertures 12 formed inside the passage unit 4 and the nozzles 8 formed on the bottom face of the passage unit 4 should be indicated by a broken line, they are indicated by the thick line.

From the manifold channel 5 formed in the passage unit 4, four sub-manifold channels 5*a* are branched. The sub-manifold channels 5*a* are disposed in a region opposed to the actuator unit 21 inside the passage unit 4 and extend adjacent to each other.

Many pressure chambers 10 are formed on the top face of the passage unit 4 in such a fashion as to open in the form of a matrix over substantially whole region opposed to the actuator unit 21. Each of the pressure chambers 10 is a hollow region having a substantially rhomboid flat shape with round corners. The pressure chambers 10 which correspond to each of the actuator units 21 form a pressure chamber group 9. The pressure chamber group 9 occupies a region having the size and the shape that are substantially the same as those of the actuator unit 21. An opening of the pressure chamber 10 is closed by the actuator unit 21 disposed on the top face of the passage unit 4.

Individual electrodes 35 which will be described later are formed at positions on the actuator unit 21 and corresponding to the pressure chambers 10. Each of the individual electrodes 35 has the size smaller than that of the pressure chamber 10 and the shape substantially the same as that of the pressure chamber 10, so that the individual electrode 35 is disposed inside the region opposed to the pressure chamber 10 on the top face of the actuator unit 21.

The nozzles 8 are formed at positions avoiding the regions that are opposed to the sub-manifold channels 5*a* on the bottom surface of the passage unit 4. The nozzles 8 are disposed in the region opposed to the actuator unit 21 on the bottom face of the passage unit 4. The nozzles 8 in each of the regions are arranged at a constant spacing along straight lines parallel to the longitudinal direction of the passage unit 4.

The nozzles 8 are formed at positions where projection points obtained by projecting the positions of the nozzles 8 from a direction perpendicular to a virtual straight line parallel to the longitudinal direction of the passage unit 4 are aligned at constant spacing corresponding to a resolution of printing and without discontinuation. Therefore, the inkjet head 2 performs printing at a spacing corresponding to the resolution of printing and without discontinuation over substantially the whole area in the longitudinal direction in which the nozzles 8 are formed in the passage unit 4.

Figure 4:
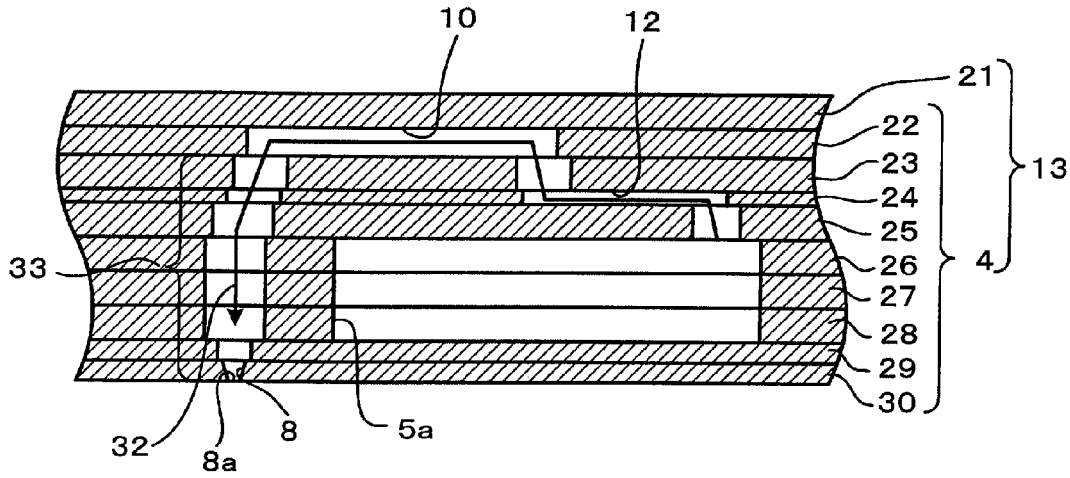
FIG. 4 is a vertical sectional view taken along the line IV-IV of FIG. 3.

Many apertures 12 are formed inside the passage unit 4 in such a fashion as to extend along the parallel direction on a horizontal surface (see FIG. 4). The apertures 12 are disposed in regions opposed to the pressure chamber group 9.

Many individual ink passages 32 extending from outlets of the sub-manifold channels 5*a* to ejection openings 8*a* at tips of the nozzles 8 via the apertures 12 and the pressure chambers 10 are formed inside the passage unit 4 (see FIG. 4). The ink supplied to the manifold channel 5 is supplied from the sub-manifold channels 5*a* to the individual ink passages 32 to be ejected from the ejection openings 8*a*.

Hereinafter a sectional structure of the head main body 13 will be described. FIG. 4 is a longitudinal sectional view taken along the line IV-IV of FIG. 3.

The passage unit 4 included in the head main body 13 has a lamination structure wherein nine plates, namely, from the top to the bottom, a cavity plate 22, a base plate 23, an aperture plate 24, a supply plate 25, manifold plates 26, 27, and 28, a cover plate 29, and a nozzle plate 30 are laminated. Many holes are formed in each of the plates. The plates 22 to 30 are laminated with the holes being matched to one another so as to form the individual ink passages 32 and the sub-manifold channels 5*a*. As shown in FIG. 4, the pressure chamber 10, the sub-manifold channel 5*a*, the nozzle 8, and the aperture 12 are formed at the positions different from one another with respect to a direction of the thickness of the plates, i.e., the pressure chamber 10 is formed on the top face of the passage unit 4; the sub-manifold channel 5*a* is formed inside the passage unit 4; the nozzle 8 is formed on the bottom face of the passage unit 4; and the aperture 12 is formed between the pressure chamber 10 and the sub-manifold channel 5*a*.

Holes corresponding to the sub-manifold channel 5*a* are formed on the manifold plates 26 to 28. On the plates 23 to 25, holes forming a second ink passage extending from the outlet of the sub-manifold channel 5*a* to an inlet of the pressure chamber 10 and including the aperture 12 are formed. On the cavity plate 22, holes corresponding to the pressure chamber 10 are formed. On the plates 23 to 29, holes forming a passage extending from the outlet of the pressure chamber 10 to the inlet of the nozzle 8 are formed. On the nozzle plate 30, holes corresponding to the nozzle 8 are formed. A passage extending from the outlet of the pressure chamber 10 to the ejection opening 8*a* at the tip of the nozzle 8 is referred to as a first ink passage 33 or a descender.

The ink supplied to the sub-manifold channel 5*a* proceeds to the nozzle 8 via the following route. Firstly, the ink proceeds upward from the sub-manifold channel 5*a* to reach one end of the aperture 12. Then, the ink proceeds horizontally along a direction of extension of the aperture 12 to reach the other end of the aperture 12. After that, the ink proceeds upward to reach one end of the pressure chamber 10 serving as the inlet of the pressure chamber 10. Further, the ink proceeds inside the pressure chamber 10 horizontally along a direction of extension of the pressure chamber 10 to reach the other end of the pressure chamber 10 serving as the outlet of the pressure chamber 10. After that, the ink proceeds orthogonally downward via the holes formed on the three plates 23 to 25 to proceed to the nozzle 8 formed below.

Figure 5:
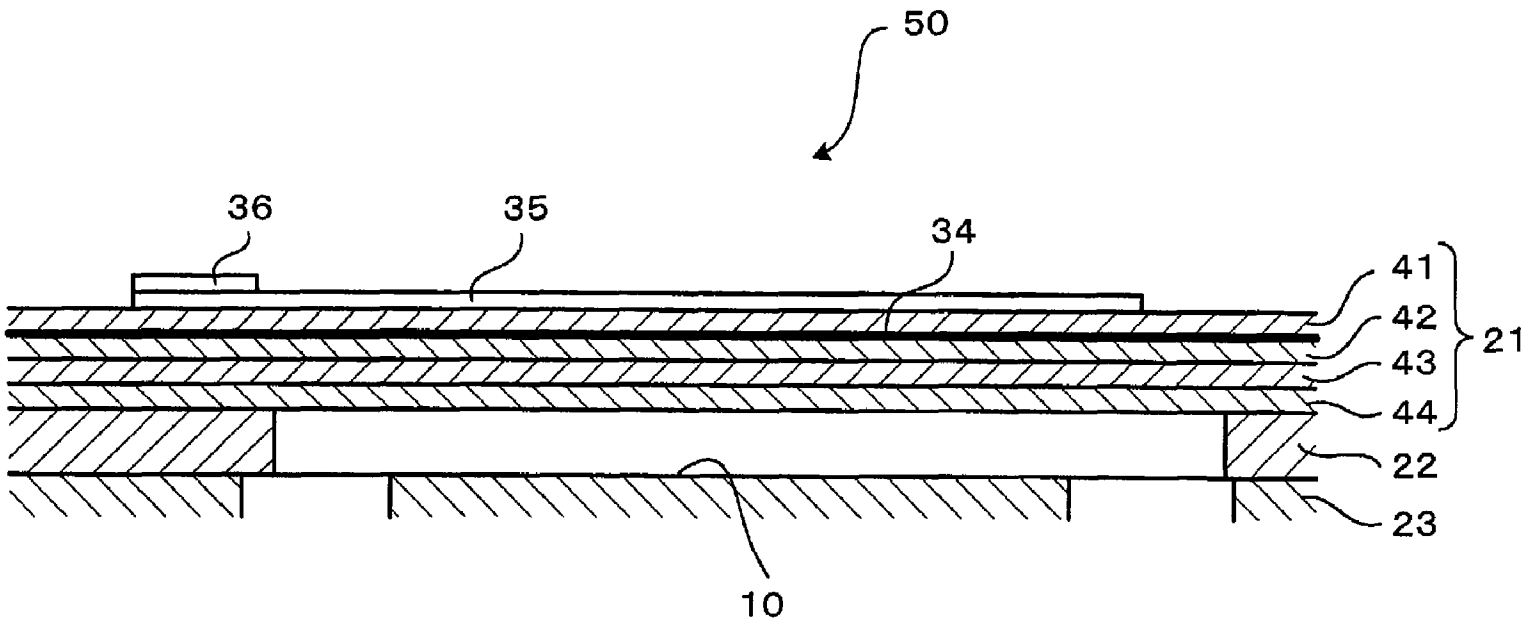
FIG. 5 is a partial enlarged view showing a piezoelectric actuator and its vicinity shown in FIG. 4.

The actuator unit 21 has a lamination structure wherein four piezoelectric layers 41 to 44 are laminated as shown in FIG. 5. Each of the piezoelectric layers 41 to 44 has a thickness of about 15 μm, and a thickness of the overall actuator unit 21 is about 60 μm. Each of the piezoelectric layers 41 to 44 forming the actuator unit 21 extends in such a manner as to overlap the pressure chambers 10 included in the pressure chamber group 9 (see FIG. 3). The piezoelectric layers 41 to 44 are made from a lead zirconate titanate-based (PZT-based) ceramic material having ferroelectricity.

The actuator unit 21 has the individual electrodes 35 and a common electrode 34 which are made from a metal material of Ag—Pd-based or the like. The individual electrode 35 is disposed at the position opposed to the pressure chamber 10 on the top face of the actuator unit 21 as described above. One end of the individual electrode 35 is extended out of the region opposed to the pressure chamber 10, and a land 36 is formed on the end. The land 36 is made from gold containing a glass frit, for example, and has a thickness of 15 μm to form a projection. The land 36 is electrically connected to a contact provided in an FPC (Flexible Printed Circuit) (not shown). The controller 100 supplies a voltage pulse signal to the individual electrode 35 through the FPC as described later.

The common electrode 34 is disposed between the piezoelectric layers 41 and 42 to extend over a substantially whole area of the layers 41 and 42. That is, the common electrode 34 so extends as to overlap over all the pressure chambers 10 in the region opposed to the actuator unit 21. The common electrode 34 has a thickness of about 2 μm. The common electrode 34 is grounded at a region not shown in the drawings and maintained to a ground potential.

As shown in FIG. 5, the uppermost piezoelectric layer 41 is sandwiched between the common electrode 34 and the individual electrodes 35. Portions sandwiched between the respective individual electrodes 35 and the common electrode 34 in the piezoelectric layer 41 are referred to as active portions. In the actuator unit 21, only the uppermost piezoelectric layer 41 includes the active portions, and other piezoelectric layers 42 to 44 do not include any active portion. That is, the actuator unit 21 is of a so-called unimorph type.

As described later, pressure is applied to ink inside the pressure chambers 10 corresponding to an individual electrode 35 when a predetermined voltage pulse signal is selectively applied to the individual electrode 35. Thus, the ink is ejected from the ejection opening 8*a* of the corresponding nozzle 8 through the individual ink passage 32. More specifically, portions of the actuator unit 21 opposed to the respective pressure chambers 10 correspond to individual piezoelectric actuators 50 corresponding to the pressure chambers 10. In this embodiment, an amount of the ink ejected from the ejection opening 8*a* by one ejection operation is about 3 to 4 pl (picolitter).

Hereinafter, control on the actuator unit 21 will be described. The printer 1 has the controller 100 and a driver IC 80 for controlling the actuator unit 21. The printer 1 has a CPU (Central Processing Unit), a ROM (Read Only Memory) for storing programs executed by the CPU and data used for the programs, and a RAM (Read Access Memory) for temporarily storing data during execution of the programs. The controller 100 having functions described below is constructed by the CPU, the ROM, and the RAM.

Figure 6:
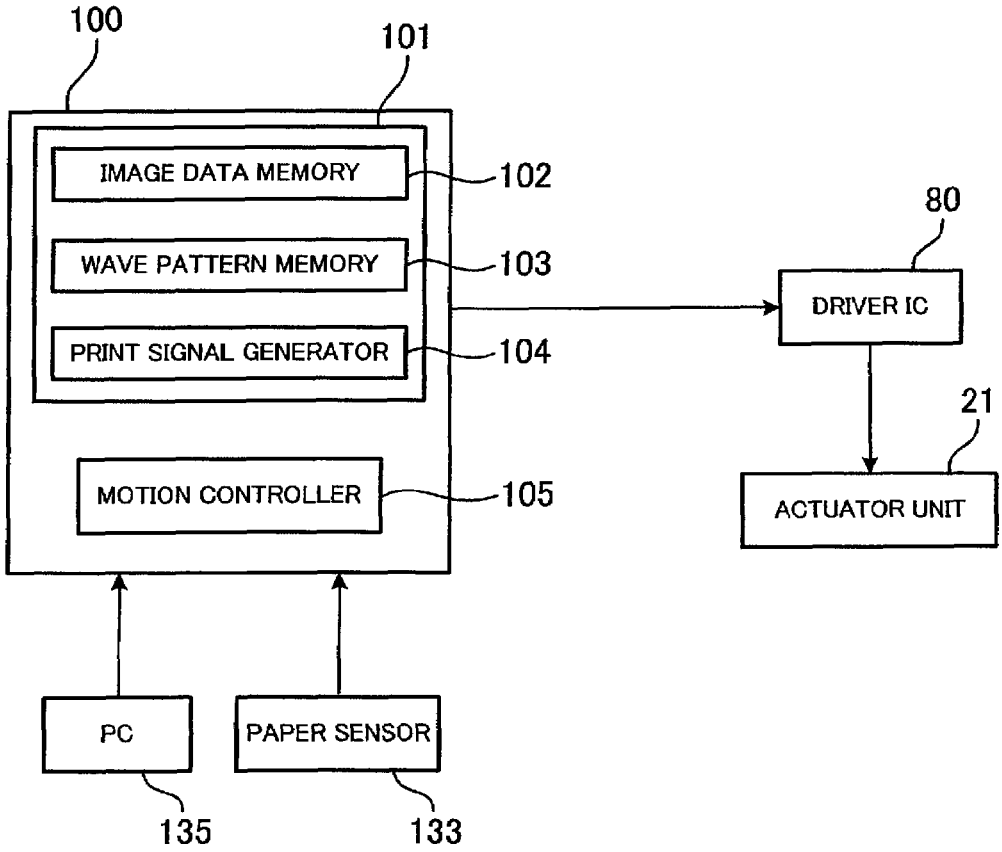
FIG. 6 is a diagram for explaining a controller included in the printer shown in FIG. 1.

The controller 100 has a print controller 101 and a motion controller 105 as shown in FIG. 6. The print controller 101 has an image data memory 102, a wave data memory 103, and a print signal generator 104. The image data memory 102 stores image data relating to printing sent from a PC (Personal Computer) 135 or the like.

The wave data memory 103 stores wave data relating to basic waves of voltage pulse signals corresponding to gradation scales or the like of the image. When a voltage pulse signal corresponding to a certain gradation scale is supplied to the individual electrode 35 via the driver IC 80, ink is ejected from the inkjet head 2 in an amount corresponding to the gradation scale.

The print signal generator 104 generates serial print data based on the image data stored in the image data memory 102. The print data are data for giving instructions that a voltage pulse signal corresponding to any one of the basic waves indicated by the wave data stored in the wave data memory 103 is to be supplied at a predetermined timing to the individual electrodes 35. The print signal generator 104 outputs the generated print data to the driver IC 80.

The driver IC 80 is provided in each of the actuator units 21 and has a shift register, a multiplexer, and a drive buffer (not shown).

The shift register converts the serial print data outputted from the print signal generator 104 into parallel data. More specifically, the shift register outputs independent data for each of the piezoelectric actuators 50 corresponding to the respective pressure chambers 10 based on the serial print data.

The multiplexer selects an appropriate wave signal from basic wave signals indicated by the wave data stored in the wave data memory 103 for each of the individual electrodes 35 based on the parallel data outputted from the shift register. The multiplexer outputs the basic wave signal selected for each of the individual electrodes 35 to the drive buffer.

The drive buffer generates a voltage pulse signal having a predetermined level for each of the individual electrodes 35 based on the basic wave signal outputted from the multiplexer. The drive buffer supplies the voltage pulse signals to the respective individual electrodes 35 corresponding to the piezoelectric actuators 50 via the FPC.

Hereinafter, a change in potential in the individual electrode 35 to which the voltage pulse signal has been supplied will be described.

Figure 7:
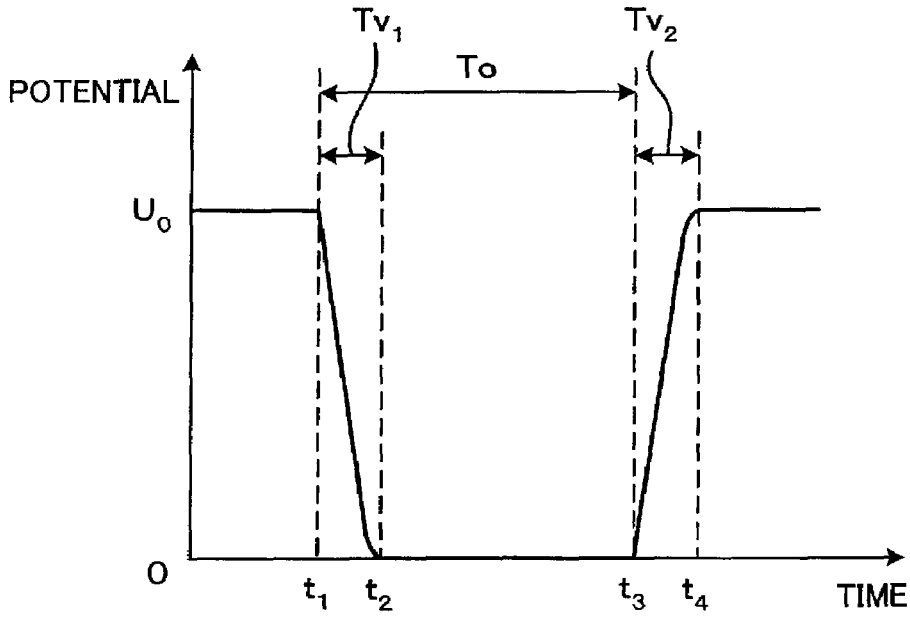
FIG. 7 is a graph showing one example of a change in potential in an individual electrode to which a voltage pulse signal is supplied.

Shown in FIG. 7 is one example of a change in potential in the individual electrode 35 to which a voltage pulse signal for causing an ink droplet to be ejected from the ejection opening 8*a* has been supplied. A waveform of the voltage pulse signal to be supplied to the individual electrode 35 is a simple rectangular wave where each of a rising edge and a trailing edge has an angle of 90 degrees. The waveform has a pulse width To and indicates a high level potential $U_0$ and a low level potential 0 as shown in FIG. 7.

At time t1, the supply of the voltage pulse signal to the individual electrode 35 is started. The time t1 is adjusted in accordance with a timing at which the ink is ejected from the ejection opening 8*a*. During a time period till the time t1 and a time period after time t4, the potential of the individual electrode 35 is maintained to $U_0$ ($\neq 0$). During a time period from time t2 to time t3, the individual electrode 35 is maintained to the ground potential. A time period from the time t1 to the time t2 is a transition period during which the potential of the individual electrode 35 changes from $U_0$ to the ground potential. A time period from the time t3 to the time 4 is a transition period during which the potential of the individual electrode 35 changes from the ground potential to $U_0$. As shown in FIG. 5, since the piezoelectric actuator 50 has the constitution similar to that of a condenser, the above-described transition periods are generated when the potential of the individual electrode 35 changes.

A length $Tv_1$ of the transition period from the time t1 to time t2 and a length $Tv_2$ of the transition period from the time t3 to the time t4 depend on the size and the shape of the individual electrode 35, a distance between the individual electrode 35 and the common electrode 34, a dielectric constant of the piezoelectric layer 41, and the waveform of the voltage pulse signal supplied to the individual electrode 35. In this embodiment, the size and the shape of the individual electrode 35, the distance between the individual electrode 35 and the common electrode 34, and the dielectric constant of the piezoelectric layer 41 are set to predetermined values, and the waveform of the voltage pulse signal applied to the individual electrode 35 is preliminary adjusted so that $0.5\ Td \leqq Tv_1 \leqq 0.6\ Td$ and $0.33\ Td \leqq Tv_2 \leqq 0.44\ Td$ are satisfied when a characteristic vibration period in ink filled in the first ink passage 33 is set to Td. Further, the waveform of the voltage pulse signal is adjusted so that a length of a time period from the time t1 to the time t3, i.e., the pulse with To, is in a range enabling the desired ink to be ejected from the ejection opening 8*a* of the nozzle 8 corresponding to the individual electrode 35. Such voltage pulse signal is supplied to the individual electrode 35, so that a prominent reduction in ink ejection speed is prevented and thus the ink ejection is maintained at the most stable state.

Hereinafter, description on how the piezoelectric actuator 50 is driven when the voltage pulse signal is supplied to the individual electrode 35 will be given.

In the actuator unit 21 in the embodiment shown in FIG. 5, only the uppermost piezoelectric layer 41 is polarized in a direction toward the common electrode 34 from the individual electrode 35. Therefore, by setting the potential of the individual electrode 35 to a value different from that of the common electrode 34, and by applying to the piezoelectric layer 41 an electric field in a direction same as the polarization direction, a portion to which the electric field was applied, i.e., an active portion, starts to extend in a thickness direction, i.e., in the lamination direction. At the same time, the active portion starts to shrink in a direction perpendicular to the lamination direction, i.e., in a surface direction of the layer 41. In contrast, the rest of three piezoelectric layers 42 to 44 do not spontaneously deform upon application of the electric field since they are not polarized.

Accordingly, the piezoelectric layer 41 and the piezoelectric layers 42 to 44 exhibit different strains, so that the piezoelectric actuators 50 as a whole are deformed to form a projection toward the pressure chambers 10, i.e., present a unimorph deformation.

Figure 8A:
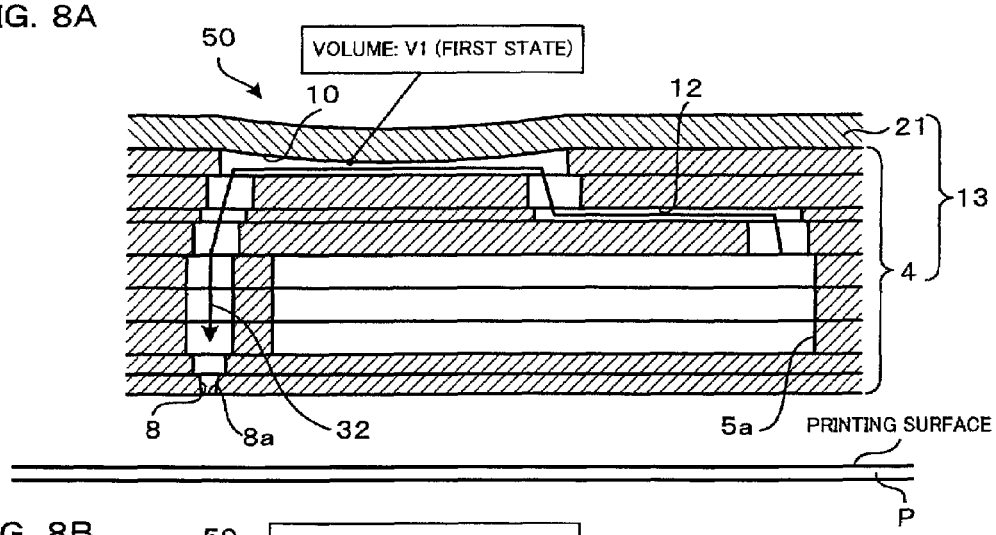
FIG. 8A, FIG. 8B, and FIG. 8C are diagrams each showing a driving of the piezoelectric actuator when the potential of the individual electrode is changed as shown in FIG. 7 upon supply of the voltage pulse signal.
Figure 8B:
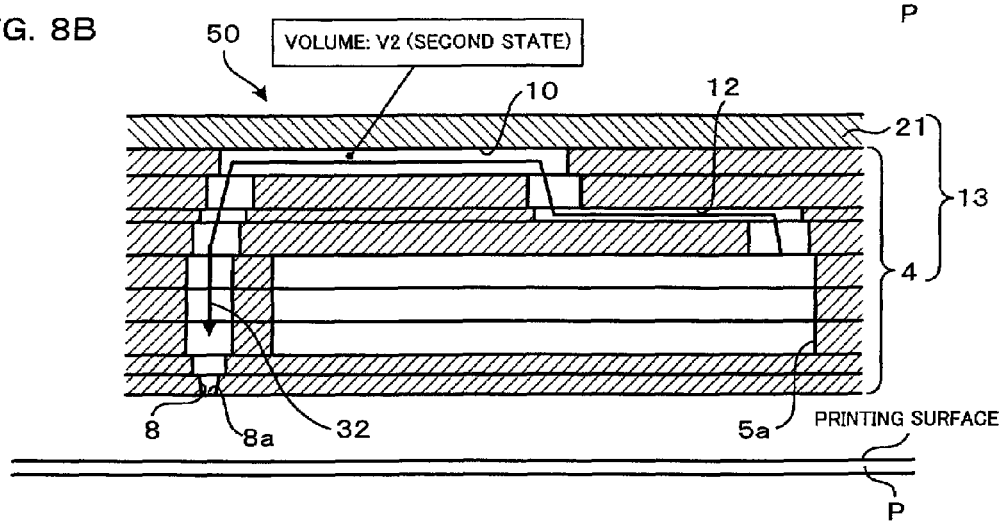
Figure 8C:
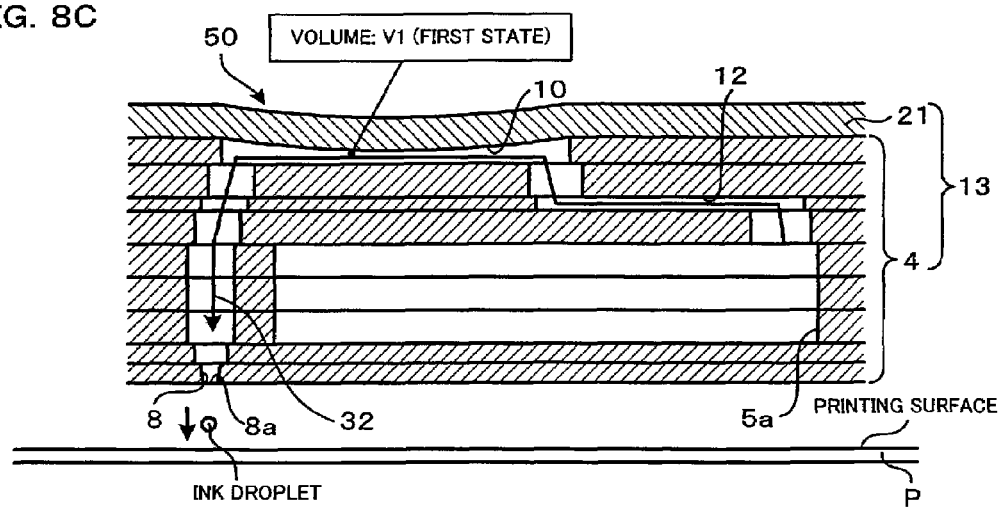

FIGS. 8A to 8C are diagrams generally showing a change with time of the piezoelectric actuator 50 when the potential of the individual electrode changes due to the supply of the voltage pulse signal as shown in FIG. 7.

Shown in FIG. 8A is a state of the piezoelectric actuator 50 during the time period till the time t1 shown in FIG. 7. During this time period, the potential of the individual electrode 35 is $U_0$. Therefore, the piezoelectric actuator 50 is projected toward the pressure chamber 10 due to the above-described unimorph deformation. A volume of the pressure chamber 10 during this time period is V1. This state will be referred to as a first state of the pressure chamber 10.

Shown in FIG. 8B is a state of the piezoelectric actuator 50 during the time period from the time t2 to the time t3 shown in FIG. 7. During this time period, the potential of the individual electrode 35 is the ground potential. Therefore, the electric field that has been applied to the active portion of the piezoelectric layer 41 is released so that the unimorph deformation of the piezoelectric actuator 50 is released. A volume V2 of the pressure chamber 10 during this time period is larger than the volume V1 of the pressure chamber 10 shown in FIG. 8A. This state will be referred to as a second state of the pressure chamber 10. As a result of the increase in volume of the pressure chamber 10, the ink is drawn into the pressure chamber 10 from the sub-manifold channel 5*a*.

Shown in FIG. 8C is a state of the piezoelectric actuator 50 during the time period after the time t4 shown in FIG. 7. During this time period, the potential of the individual electrode 35 is $U_0$. Therefore, the piezoelectric actuator 50 is returned to the first state. Since the piezoelectric actuator 50 changes the pressure chamber 10 from the second state to the first state, pressure is applied to the ink in the pressure chamber 10. Thus, an ink droplet is ejected from the ejection opening 8*a* at the tip of the nozzle 8. The ink droplet lands on a printing surface, i.e., the top face, of the printing paper P to form a dot.

As described above, in the driving of the piezoelectric actuator 50 according to this embodiment, the volume of the pressure chamber 10 is temporarily increased to generate a negative pressure wave in the ink in the pressure chamber 10 (from FIG. 8A to FIG. 8B) Then, the pressure wave is reflected at the end of an ink passage inside the passage unit 4 to be returned as a positive pressure wave proceeding to the nozzle 8. At a timing when the positive pressure wave reaches to the pressure chamber 10, the volume of the pressure chamber 10 is reduced again (from FIG. 8B to FIG. 8C). This is the so-called fill before fire method.

In order to eject ink by the above-described fill before fire method, the pulse width To (see FIG. 7) of the voltage pulse signal is adjusted to AL. AL means a length of time required for a pressure wave generated in the pressure chamber 10 to transmit from the end of the aperture 12 near the pressure chamber 10 to the ejection opening 8*a* at the tip of the nozzle 8. As the pulse width To is adjusted to AL, the positive pressure wave reflected as described above and the positive pressure wave generated due to the deformation of the piezoelectric actuator 50 superimpose on each other to thereby apply stronger pressure to ink. Therefore, as compared to the case of reducing the volume of the pressure chamber 10 once to push out the ink in the pressure chamber 10, the driving voltage of the piezoelectric actuator 50 for ejecting the same amount of ink can be lower. Consequently, the fill before fire method is advantageous from the stand points of high collection in the pressure chamber 10, compact size of the inkjet head 2, and a running cost for driving the inkjet head 2.

The timing at which the potential of the individual electrode 35 changes substantially coincides with the timing at which the piezoelectric actuator 50 deforms. Therefore, in this specification, it is assumed that the timing at which the potential of the individual electrode 35 changes coincides with the timing at which the piezoelectric actuator 50 deforms. For example, in FIG. 7, the volume of the pressure chamber 10 starts to diminish at the same time when the potential of the individual electrode 35 starts to diminish at the time t1. Then, the volume of the pressure chamber 10 becomes the minimum value at the same time when the potential of the individual electrode 35 becomes the ground potential at the time t2. Even if the timing at which the potential of the individual electrode 35 changes was different from the timing at which the actuator 50 deforms, this invention can be applied in view of the difference in advance.

Hereinafter, the analysis conducted by the inventors of this invention will be described.

In this analysis, as a pressure actuator for applying pressure to ink, the piezoelectric actuator 50 shown in FIG. 5 is used. As described above, the piezoelectric actuator 50 has the individual electrode 35 and the common electrode 34, and the common electrode 34 is continuously maintained to the ground potential. When the potential of the individual electrode 35 becomes that other than the ground potential, the piezoelectric actuator 50 deforms due to the piezoelectric strain to change the volume of the pressure chamber 10. When the pressure wave generated due to the volume change of the pressure chamber 10 reaches to the nozzle 8, the meniscus of the ink formed in the nozzle 8 is deformed, so that a part of the ink forming the meniscus is ejected as an ink droplet. After that, for the next ejection, ink is supplied from the upstream of the pressure chamber 10, for example, from the sub-manifold channel 5*a* shown in FIG. 4, in an amount equal to that previously ejected. In this analysis, ink is ejected from the ejection opening 8*a* by the fill before fire method performed by deforming the piezoelectric actuator 50 by supplying a predetermined voltage pulse signal to the individual electrode 35.

Figure 9:
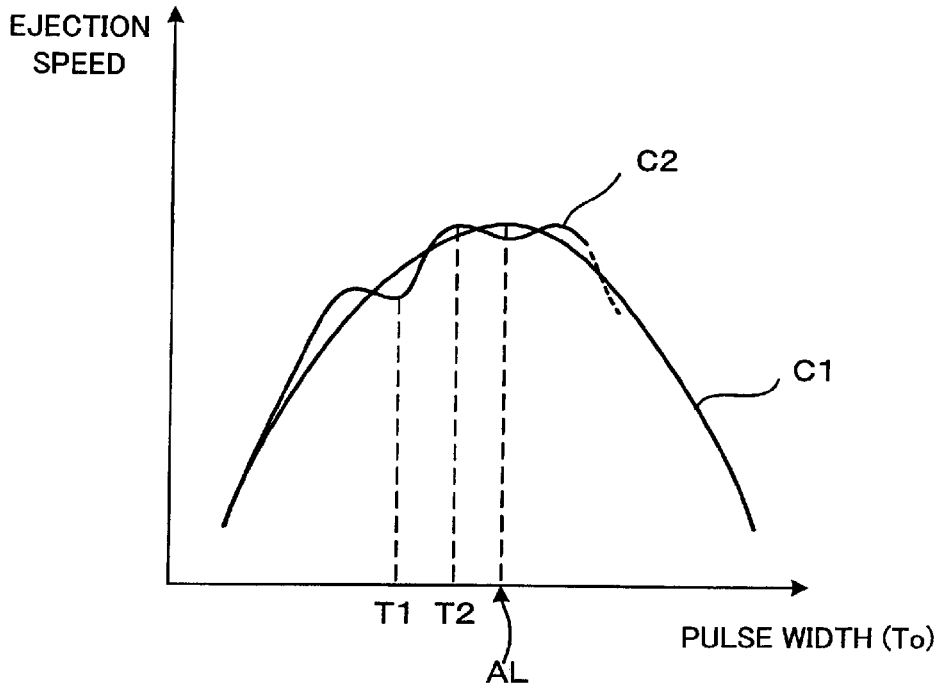
FIG. 9 is a graph showing the speed of an ejected ink with respect to a width To shown in FIG. 7.

FIG. 9 is a graph showing the speed of ink ejected by the voltage pulse signal varied in pulse width To (see FIG. 7). By the conventional approximative calculation, a function of the ink ejection speed with respect to the pulse width To is a curve C1 having a maximum value when To=AL. However, the inventors have confirmed that a curve C2 having several local maximal values and local minimal values when the pulse width To is other than AL is obtained in actuality.

It has been confirmed that, in To=T1 where the ejection speed becomes the local minimal in the range of To<AL, an ejected ink droplet is broken up so that high speed small droplets are generated. It has also been confirmed that, in To=T2 where the ejection speed becomes the local maximal when To<AL, influence of the change in pressure applied from the piezoelectric actuator 50 upon the ink ejection speed is enhanced, so as to cause a large increase in the ink ejection speed. In such case, deterioration in image reproducibility is raised due to noise or variation in ink ejection speed.

The inventors have considered that the function of the ejection speed with respect to the pulse width To takes the local maximal or minimal value when To is other than AL as in the curve C2 due to the following causes. That is, it is considered that the ink ejection speed has the characteristics indicated by the curve C1 due to the pressure wave in the ink filled in the individual ink passage 32 of the head 2. It has also been considered that the characteristics of the curve C2 appear due to vibration generated in a local range different from the range in which the pressure wave imparting the characteristics of the curve C1 transmits, more specifically, due to characteristic vibration of ink filled in the first ink passage 33 described above (see FIG. 4).

The characteristic vibration is considered to occur as described below. When the pressure wave arises in the ink in the pressure chamber 10 due to the deformation of the piezoelectric actuator 50, the pressure wave transmits in a direction upstream of the pressure chamber 10, i.e., in a direction oriented to the sub-manifold channel 5*a*, as well as to a downstream direction, i.e., in a direction oriented to the nozzle 8 (see FIG. 4). In the fill before fire method, the volume of the pressure chamber 10 is temporarily increased and then returned to the original volume after the time period corresponding to the pulse width To, so that ink is ejected from the ejection opening 8*a* as described above. In increasing the volume of the pressure chamber 10, the negative pressure wave (hereinafter referred to as first pressure wave) occurs in the ink in the pressure chamber 10, and, in subsequently reducing the volume, the positive pressure wave (hereinafter referred to as second pressure wave) occurs in the ink in the pressure chamber 10. A part of the pressure wave transmits to the first ink passage 33 at the downstream as described above. Therefore, the first pressure wave transmitted to the first ink passage 33, for example, is reflected at one end of the first ink passage 33, i.e., at the boundary between the pressure chamber 10 and the first ink passage 33, or near the nozzle 8. Due to the reflected wave, the characteristic vibration arises in ink filled in the first ink passage 33.

In turn, a part of the first pressure wave transmits toward the sub-manifold channel 5*a*. The part of the first pressure wave is reflected at the end of the aperture 12 near the pressure chamber 10 and then transmitted, as a pressure wave of which the polarity is reversed, toward the pressure chamber 10 and the first ink passage 33 to proceed to the ejection opening 8*a*. That is, the part of the first pressure wave returns to the pressure chamber 10 as a positive pressure wave (hereinafter referred to as third pressure wave) after the reversal of pressure when reflected at the end of the aperture 12.

Ink is ejected from the ejection opening 8*a* when the synthetic wave produced by the overlapping of the second pressure wave with the third pressure wave reaches to the nozzle 8 as a proceeding wave. A part of the second and the third pressure waves is overlapped with the characteristic vibration wave generated in the first ink passage 33 by the part of the first pressure wave. Therefore, when the second and the third pressure waves reach to the nozzle 8 as the proceeding wave, not only a vibration produced by the proceeding wave but also a synthetic vibration produced by the overlapping of the vibration generated by the part of the second and the third pressure waves with the vibration generated by the first pressure wave is observed in the vicinity of the nozzle 8.

In such ink ejection by the piezoelectric actuator 50, the case wherein To=AL corresponds to the case wherein the second pressure state (see FIG. 8B) of the pressure 10 starts to be changed to the first state (see FIG. 8C) at the timing when the pressure applied to ink in the pressure chamber 10 becomes the maximum due to the third pressure wave. In the case of performing the fill before fire method with To=AL, the second and the third pressure waves that are overlapped with each other at the timing when the ink ejection speed becomes the local maximal value indicated by the curve C1 in FIG. 9 reach the nozzle 8.

The case wherein the state of the pressure chamber 10 starts to be changed from the second state to the first state at any of the timings till the pressure inside the pressure chamber 10 becomes the maximum due to the third pressure wave corresponds to the case of To<AL. The case of performing the fill before fire method with To=T2 is the case wherein the state of the pressure chamber 10 starts to be changed from the second state to the first state so as to cause the synthetic wave of the second and the third pressure waves to reach the vicinity of the nozzle 8 as the proceeding wave at the timing when the ink pressure near the nozzle 8 becomes the positive and maximum value due to the synthetic vibration. Therefore, in the case of performing the fill before fire method with To=T2, the synthetic wave of the second and the third pressure waves reaches to the vicinity of the nozzle 8 when the pressure of the ink in the vicinity of the nozzle 8 becomes the maximum value caused by the synthetic vibration due to the first to the third pressure waves. Consequently, in the vicinity of the nozzle 8, the positive pressure synthetic wave transmitted from the pressure chamber 10 is overlapped with the maximum positive pressure caused by the synthetic vibration, so that the ejection speed becomes the local maximal value as shown in FIG. 9.

The case of performing the fill before fire method with To=T1 corresponds to the case of causing the state of the pressure chamber 10 to start changing from the second state to the first state in such a manner that the synthetic wave of the second and the third pressure waves reaches to the vicinity of the nozzle 8 as the proceeding wave at the timing when the ink pressure near the nozzle 8 becomes the negative maximum value due to the synthetic vibration. Therefore, since the positive synthetic wave overlaps with the negative maximum pressure caused by the synthetic vibration near the nozzle 8 when the fill before fire method is performed with To=T1, the ejection speed becomes the local minimal value as shown in FIG. 9.

Figure 10A:
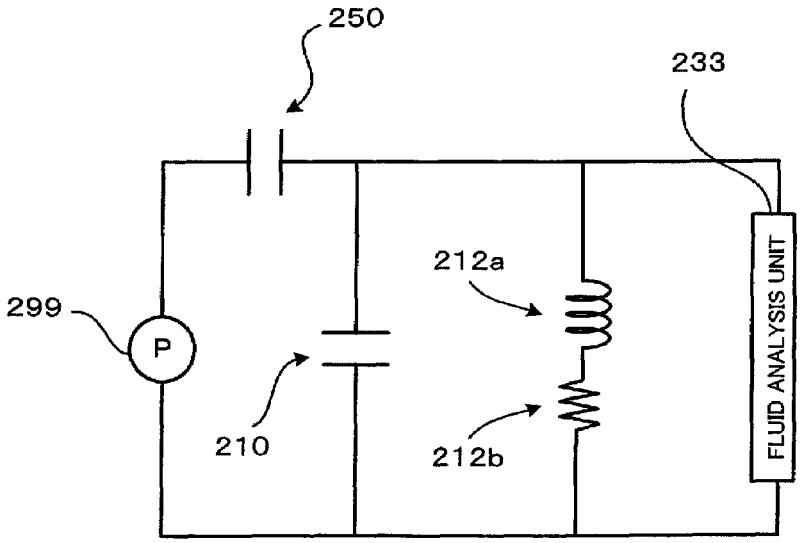
FIG. 10A is a diagram showing an equivalent circuit obtained by modeling an individual ink passage shown in FIG. 4, which was used in analysis by the inventors of this invention.
Figure 10B:
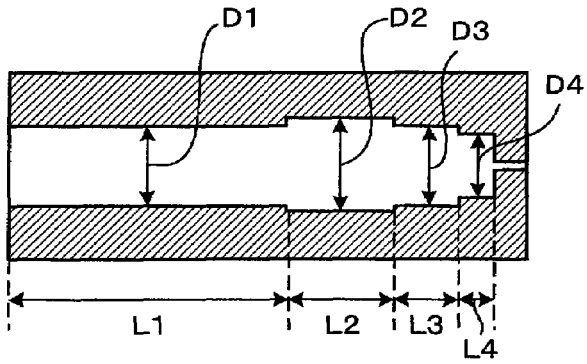
FIG. 10B is a diagram showing a structure of a first ink passage in a fluid analysis unit showing in FIG. 10A.
Figure 10C:
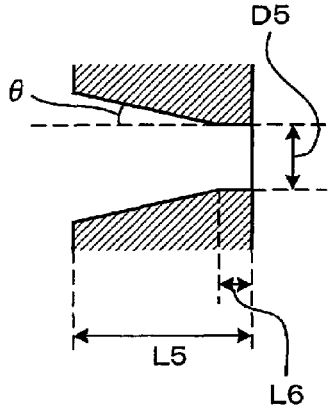
FIG. 10C is a diagram showing a structure of a nozzle in the first ink passage shown in FIG. 10B.

When the reason for the function of the ink ejection speed with respect to the pulse width To takes the several extreme values as indicated by the curve C2 of FIG. 9 is in the characteristic vibration of ink filled in the first ink passage 33 as described above, the extreme values of the curve C2 do not appear if the characteristic vibration was not generated. Also, it is considered that the above-described characteristic vibration can be prevented by adapting the waveform of the voltage pulse signal supplied to the individual electrode 35 to conditions determined to be preferable in analysis results described later when the fill before fire method is performed by the piezoelectric actuator 50. In order to confirm the above consideration, the inventors have conducted the simulation described below. FIGS. 10A to 10C are diagrams showing contents of the simulation.

In conducting the simulation, the individual ink passage 32 shown in FIG. 4, i.e., the passage extending from the outlet of the sub-manifold channel 5*a* to the ejection opening 8*a* at the tip of the nozzle 8 via the aperture 12 and the pressure chamber 10, is used as a circuit obtained by acoustically subjecting the passage to equivalent conversion (see FIG. 10A), and acoustic analysis on the equivalent circuit was performed. In the circuit of FIG. 10A, the aperture 12 corresponds to a coil 212*a* and a resistance 212*b*, the piezoelectric actuator 50 corresponds to a condenser 250, and the pressure chamber 10 corresponds to a condenser 210. The first ink passage 33 corresponds to a fluid analysis unit 233 in this circuit. The fluid analysis unit 233 is not considered as a component of the circuit, such as the condenser and the resistance, but is to be subjected to numerical analysis by fluid analysis described later.

For the acoustic analysis of this simulation, the thickness of the piezoelectric actuator 50, an area and a depth of the pressure chamber 10 with respect to a thickness direction of the piezoelectric actuator 50, a width, a length, and a depth of the aperture 12 with respect to the thickness direction, and the like are used. Compliance (acoustic capacity) of the piezoelectric actuator 50, i.e., a capacity of the condenser 250 in the equivalent circuit, and a pressure constant are preliminary determined from the construction of the piezoelectric actuator 50 and the like by employing the finite element method. The piezoelectric constant is determined by employing the resonance method for measuring impedance of a piezoelectric element.

Shown in FIG. 10B is a structure of the first ink passage 33 in the fluid analysis unit 233. Shown in FIG. 10C is a structure of the nozzle 8 in the first ink passage 33 shown in FIG. 10B. In FIG. 10B, a range corresponding lengths L1, L2, L3 and L4 indicates the first ink passage 33 excluding the nozzle 8. The left end of FIG. 10B is a part connected to the pressure chamber 10. Inner diameters D1, D2, D3 and D4 and the lengths L1 to L4 of the first ink passage 33 used in this fluid analysis are as shown in Table 1. A diameter D5 of the tip of the nozzle 8, i.e., of the ejection opening 8*a*, and other elements L5, L6, and θ are as shown in Table 2.

TABLE 1

| INNER DIAMETER [μm] | | LENGTH [μm] | |
|---|---|---|---|
| D1 | D2 | L1 | L2 |
| 200 | 250 | 500 | 150 |
| D3 | D4 | L3 | L4 |
| 200 | 150 | 100 | 50 |

TABLE 2

| D5 | L5 | L6 | θ |
|---|---|---|---|
| 20 μm | 50 μm | 10 μm | 8 deg |

The fluid analysis in the fluid analysis unit 233 was performed by using the structure of the first ink passage 33 described above and by employing the pseudo compression method which is fluid analysis formulated by pseudo compressibility, i.e., by employing a method of determining speed and pressure by using a simultaneous expressions consisting of a continuity expression to which "A" representing time change of density is added in a pseudo manner and the Navier-Stokes expression.

The compliance (acoustic capacity) of the pressure chamber 10, i.e., a capacity of the condenser 250 in the equivalent circuit, was determined from a relational expression C=W*Ev. In the expression, C represents the compliance; W represents the volume of the pressure chamber 10; and Ev represents a volumetric elastic modulus of the ink.

Inertance in the aperture 12, i.e., inductance of the coil 212*a* in the equivalent circuit, was determined by a relational expression m=ρ*l /A. In the expression, m represents the inertance, ρ represents a density of the ink; A represents an area of a section with respect to a direction perpendicular to the thickness direction in the aperture 12; and l represents a length of the aperture 12 with respect to a horizontal direction of FIG. 4.

A passage resistance of the aperture 12, i.e., a resistance value R of the resistance 212*b*, was determined as follows. In the above embodiment, the aperture 12 has the rectangular shape of which the sides with respect to the direction perpendicular to the thickness direction have the lengths 2*a* and 2*b*. In such case, the amount of ink flowing through the aperture 12 is represented by using the following Expression 1. A relationship of the pressure Δp applied to the aperture 12, i.e., the strength of the pressure wave, and the amount Q of ink flowing through the aperture 12 is represented by Q=Δp/R. The resistance value R is calculated by using this expression and Expression 1. Here, l represents a length of the aperture 12 as described above, and μ represents the viscosity of ink.

$$Q = \frac{4ab^3\Delta p}{3\mu l}\left[1 - \frac{192b}{\pi^5 a}\sum_{n=1,3,\ldots}^{\infty}\frac{1}{n^5}\tanh\left(\frac{n\pi a}{2b}\right)\right] \quad \text{[Expression 1]}$$

In the fluid analysis in the fluid analysis unit 233, a volumetric speed of ink passing through the fluid analysis unit 233 is determined. In the piezoelectric actuator 50, a pressure P corresponding to the voltage applied between the individual electrode 35 and the common electrode 34 is to be added by a pressure source 299 in the circuit. Under such conditions, the volumetric speed of the ink flowing through the circuit was obtained by numerical analysis, based on the pressure P, the acoustic capacity, the inertance, the resistance value, and an analysis result in the fluid analysis unit 233 separately obtained. Results of the numerical analysis are shown in Table 3.

TABLE 3

| | | $Tv_1$/Td | | | | | | | | |
|---|---|---|---|---|---|---|---|---|---|---|
| | | 0.17 | 0.25 | 0.33 | 0.42 | 0.50 | 0.58 | 0.67 | 0.75 | 0.83 |
| To/Tc | 0.64 | 57.81% | 57.00% | 57.90% | 56.94% | 54.98% | 53.91% | 51.43% | 50.80% | 48.74% |
| | 0.63 | 80.70% | 60.14% | 60.78% | 60.11% | 58.70% | 57.80% | 55.31% | 54.33% | 51.81% |
| | 0.62 | 62.70% | 63.13% | 63.54% | 62.96% | 61.48% | 60.89% | 58.43% | 57.53% | 53.29% |
| | 0.60 | 65.45% | 65.98% | 66.00% | 65.53% | 64.21% | 63.32% | 61.17% | 80.18% | 56.88% |
| | 0.59 | 68.88% | 69.20% | 68.89% | 68.58% | 66.90% | 66.05% | 63.56% | 62.75% | 58.78% |
| | 0.58 | 74.10% | 73.39% | 73.26% | 72.80% | 70.67% | 89.34% | 68.75% | 65.79% | 60.98% |
| | 0.56 | 80.75% | 79.39% | 79.10% | 77.55% | 75.06% | 73.48% | 70.14% | 69.38% | 63.55% |
| | 0.55 | 87.64% | 85.88% | 85.80% | 83.82% | 80.49% | 78.77% | 74.78% | 73.81% | 67.32% |
| | 0.54 | 94.25% | 92.32% | 91.98% | 90.21% | 86.51% | 84.19% | 79.98% | 78.47% | 71.58% |
| | 0.53 | 97.79% | 97.08% | 98.63% | 94.94% | 91.82% | 89.25% | 84.83% | 82.54% | 74.36% |
| | 0.51 | 99.02% | 99.03% | 99.17% | 98.44% | 94.97% | 92.45% | 88.01% | 85.57% | 76.89% |
| | 0.50 | 100.61% | 99.39% | 100.00% | 99.35% | 96.57% | 94.19% | 89.85% | 87.01% | 78.07% |
| | 0.49 | 100.58% | 100.48% | 99.80% | 99.48% | 96.46% | 84.66% | 90.22% | 87.43% | 78.33% |
| | 0.47 | 102.19% | 102.01% | 99.12% | 98.84% | 95.55% | 93.46% | 89.57% | 86.49% | 77.49% |
| | 0.46 | 102.98% | 101.54% | 97.57% | 96.62% | 93.26% | 91.29% | 87.87% | 84.34% | 76.34% |
| | 0.45 | 102.60% | 100.02% | 94.87% | 83.61% | 90.80% | 88.97% | 85.59% | 81.70% | 73.97% |
| | 0.44 | 102.67% | 99.39% | 93.51% | 91.88% | 88.44% | 86.43% | 83.14% | 79.15% | 72.28% |
| | 0.42 | 103.97% | 99.53% | 92.81% | 90.61% | 88.84% | 84.52% | 80.84% | 76.78% | 69.93% |
| | 0.41 | 102.92% | 98.40% | 91.95% | 89.08% | 85.01% | 82.45% | 78.34% | 74.67% | 67.75% |
| | 0.40 | 98.38% | 95.77% | 89.08% | 86.77% | 82.82% | 80.23% | 76.12% | 72.03% | 65.21% |
| | 0.38 | 92.92% | 92.12% | 85.94% | 83.82% | 78.83% | 77.47% | 73.32% | 69.10% | 63.06% |
| | 0.37 | 89.70% | 87.94% | 81.94% | 79.85% | 78.32% | 74.12% | 69.94% | 65.59% | 60.41% |
| | 0.38 | 85.63% | 82.02% | 77.15% | 75.44% | 72.12% | 70.00% | 88.59% | 61.85% | 57.58% |
| | 0.35 | 78.42% | 75.20% | 71.96% | 70.67% | 67.79% | 66.03% | 52.96% | 58.05% | 53.80% |
| | 0.33 | 70.51% | 68.35% | 67.03% | 66.09% | 63.62% | 61.96% | 58.97% | 54.34% | 50.06% |
| | 0.32 | 64.40% | 63.04% | 62.64% | 61.83% | 59.50% | 57.94% | 54.96% | 50.27% | 46.09% |

In Table 3, Td represents a characteristic vibration period of ink filled in the first ink passage 33, and Tc (=2AL) represents a characteristic vibration period of ink filled in the individual ink passage 32. Td and Tc depend on the shape of the individual ink passage 32. Since the individual ink passages 32 used in the simulations had an identical shape, Td and Tc are constant. $Tv_1$ indicates a time required for the potential of the individual electrode 35 to transitionally change from $U_0$ to the ground potential (see FIG. 7). The waveform of the voltage pulse signal was changed in order to vary $Tv_1$. Shown in Table 3 are ratios of speed of ink ejected from the ejection opening 8*a* when To/Tc changes in the range of 0.32 to 0.64 in the case where a ratio of $Tv_1$ to Td is varied in the range of 17% to 83% ($Tv_1$/Td=0.17 to 0.83). The ejection speed ratios are shown in percentages by setting the ejection speed when $Tv_1$/Td=$Tv_2$/Td=0.33 and To/Tc=0.50 to 1. The numerical analysis according to Table 3 was obtained under the condition of $Tv_2$=$Tv_1$, and the same results were obtained when $Tv_2$>$Tv_1$ and $Tv_2$<$Tv_1$.

Figure 11:
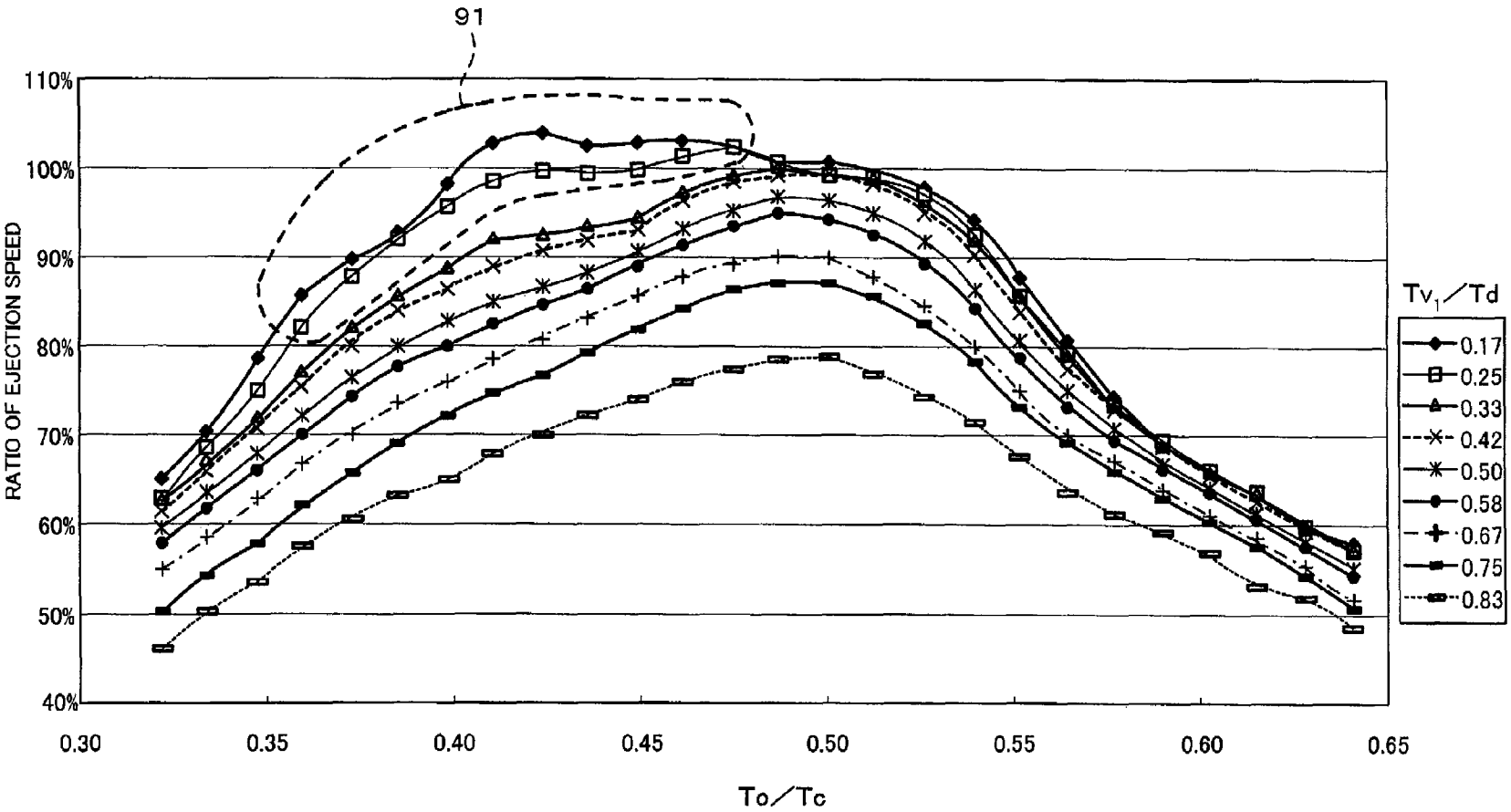
FIG. 11 is a graph showing a result of numerical analysis conducted by using the model shown in FIGS. 10A to 10C.

FIG. 11 is a graph showing the results of the numerical analysis shown in Table 3. The horizontal axis represents To/Tc, and the vertical axis represents the ratio of the ejection speed. Each of the curves shows a result per parameter $Tv_1$/Td. In the curve wherein $Tv_1$/Td is less than 0.33, i.e., the ratio of $Tv_1$ to Td is less than 33%, an extreme value of the ejection speed except for To=AL appears in the range 91 of FIG. 11. The extreme value corresponds to the extreme value indicated in the curve C2 of FIG. 9. When such extreme value appears in the ejection speed, noise or variation in ink ejection speed occurs to cause the problem of deterioration in image reproducibility as described above. Therefore, in order to avoid such problem, it is necessary to keep $Tv_1$/Td in the range that prevents the appearance of extreme value in the ejection speed.

The extreme value shown in the range 91 of FIG. 11 appears prominently in the case where the ratio of $Tv_1$ to Td is less than 33%. In turn, the curve obtained when the ratio of $Tv_1$ to Td is 33% or more approximates to the shape of the curve C1 of FIG. 9, and the extreme value seldom or never appears in the curve. Therefore, it is understood that the problem of unsatisfactory reproduction of images due to the occurrence of noise and variation in ink ejection speed hardly occurs when the ratio of $Tv_1$ to Td is 33% or more.

As shown FIG. 11, in the case where $Tv_1$/Td is 0.33 or more, the peak of the curve appears near To/Tc=0.50. Therefore, in ink ejection, To is adjusted so as to keep To/Tc close to 0.50. In turn, the peak of the curve becomes smaller along with the increase in $Tv_1$. This is because the change in voltage is moderated along with the increase in $Tv_1$ (see FIG. 7), thereby increasing the time required for the modification of the piezoelectric actuator 50. More specifically, in such case, even when the piezoelectric actuator 50 exhibits the same modification amount, a ratio contributing to the ink ejection by the pressure wave occurring in the individual ink passage 32 and the pressure wave occurring in the first ink passage 33 is reduced, thereby deteriorating efficiency of applying pressure to ink. When the ejection speed becomes too small due to the deterioration in pressurizing efficiency, a problem that ink is not ejected efficiently from the ejection opening 8*a* or the like can be raised.

Figure 12A:
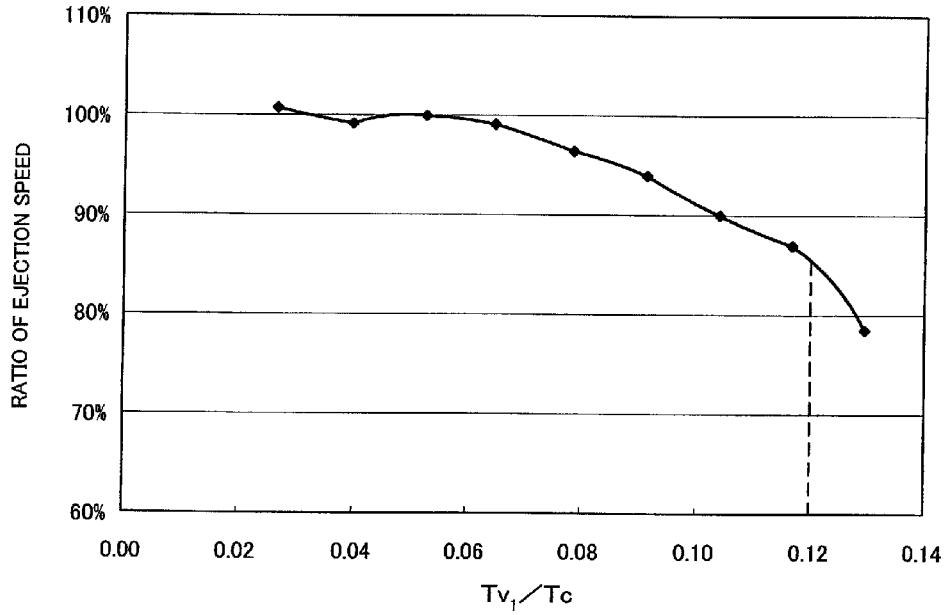
FIG. 12A and FIG. 12B are graphs each showing the result of numerical analysis conducted by using the model shown in FIGS. 10A to 10C.
Figure 12B:
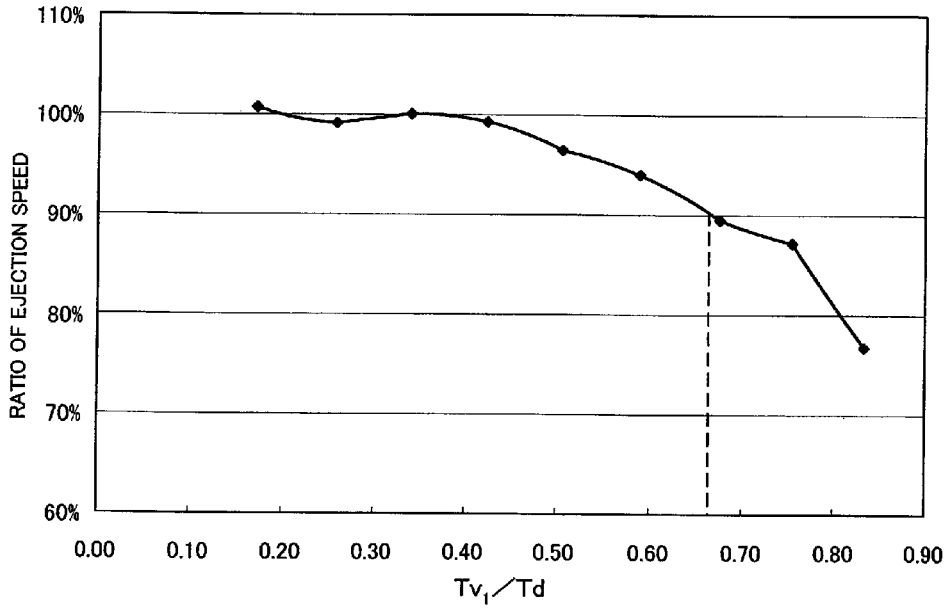

FIGS. 12A and 12B are graphs each showing a ratio of ejection speed when To/Tc=0.50, which are created based on Table 3. The horizontal axis in FIG. 12A indicates a ratio of $Tv_1$ to Tc, and the horizontal axis in FIG. 12B indicates a ratio of $Tv_1$ to Td. As shown in FIG. 12A, a reduction in ejection speed is prominent particularly when the ratio of $Tv_1$ to Tc exceeds 12%. As shown in FIG. 12B, the ejection speed becomes less than 90% of that obtained when $Tv_1$/Td=0.33 when the ratio of $Tv_1$ to Td exceeds 67%.

Therefore, it is preferable that the passage unit 4 has the sub-manifold channels 5*a* for supplying ink to the pressure chambers 10 and the second ink passage extending from the outlets of the sub-manifold channels 5*a* to the inlets of the pressure chambers 10 and that the controller 100 controls the piezoelectric actuator 50 so as to keep $Tv_1$ to 12% or less of Tc. Further, it is more preferable to control the piezoelectric actuator 50 so as to keep $Tv_1$ to 67% or less of Td. In such case, the speed of the ink ejected from the ejection opening 8*a* is ensured satisfactorily in view of the analysis. This is because the pressurizing efficiency is improved when pressure is applied satisfactorily rapidly to ink in the pressure chamber 10 by the piezoelectric actuator 50 due to $Tv_1$ that is reduced to the satisfactory value.

Further, it is understood from FIG. 12A, FIG. 12B, and Table 3 that the ratio of the ejection speed is reduced from 100% when the ratio of $Tv_1$ to Tc exceeds 6.4% or the ratio of $Tv_1$ to Td exceeds 42%. Therefore, in order to keep the ratio of the ejection speed to about 100%, it is preferable to keep the ratio of $Tv_1$ to Tc to 6.4% or less and to keep the ratio of $Tv_1$ to Td to 42% or less. With such ratios, it is possible to keep the ejection speed to the maximum value.

Table 4 shows results of the numerical analysis in the simulation, the results being different from those shown in Table 3.

TABLE 4

| | | $Tv_2$/Td | | | | | | | | |
|---|---|---|---|---|---|---|---|---|---|---|
| | | 0.17 | 0.25 | 0.33 | 0.42 | 0.50 | 0.58 | 0.67 | 0.75 | 0.83 |
| To/Tc | 0.64 | 57.85% | 57.27% | 57.90% | 56.94% | 54.98% | 53.91% | 51.43% | 50.80% | 48.74% |
| | 0.63 | 60.59% | 80.34% | 60.78% | 60.11% | 58.70% | 57.60% | 55.31% | 54.33% | 51.81% |
| | 0.62 | 62.86% | 83.25% | 63.54% | 62.95% | 61.48% | 60.69% | 58.43% | 57.53% | 53.29% |
| | 0.60 | 65.61% | 85.99% | 68.00% | 65.53% | 64.21% | 63.32% | 61.17% | 60.18% | 56.88% |
| | 0.59 | 68.93% | 69.10% | 68.89% | 68.56% | 55.90% | 66.05% | 63.55% | 62.75% | 58.78% |
| | 0.58 | 73.88% | 73.35% | 73.26% | 72.80% | 70.67% | 69.34% | 66.75% | 65.78% | 60.96% |
| | 0.58 | 80.32% | 79.30% | 79.10% | 77.55% | 75.06% | 73.46% | 70.14% | 69.38% | 63.55% |
| | 0.55 | 87.11% | 85.85% | 85.80% | 83.82% | 80.49% | 78.77% | 74.78% | 73.81% | 67.32% |
| | 0.54 | 93.64% | 92.22% | 91.98% | 90.21% | 86.51% | 84.19% | 78.88% | 78.47% | 71.58% |
| | 0.53 | 97.54% | 98.94% | 96.63% | 94.94% | 91.82% | 89.25% | 84.53% | 82.54% | 74.36% |
| | 0.51 | 99.04% | 99.07% | 99.17% | 98.44% | 94.97% | 92.45% | 88.01% | 85.57% | 76.89% |
| | 0.50 | 100.30% | 99.57% | 100.00% | 99.35% | 96.57% | 94.19% | 89.85% | 87.01% | 78.07% |
| | 0.49 | 100.49% | 100.28% | 99.80% | 99.46% | 96.46% | 94.66% | 90.22% | 87.43% | 78.33% |
| | 0.47 | 101.87% | 101.14% | 99.12% | 98.84% | 95.55% | 93.46% | 89.57% | 86.49% | 77.49% |
| | 0.46 | 102.20% | 100.38% | 87.57% | 96.62% | 93.26% | 91.29% | 87.57% | 84.34% | 78.34% |
| | 0.45 | 101.36% | 98.47% | 84.87% | 93.51% | 90.80% | 88.97% | 85.59% | 81.70% | 73.97% |
| | 0.44 | 101.16% | 97.62% | 93.51% | 91.88% | 88.44% | 86.43% | 83.14% | 79.15% | 72.28% |
| | 0.42 | 102.04% | 97.51% | 92.81% | 90.61% | 86.64% | 84.52% | 80.84% | 76.78% | 69.93% |
| | 0.41 | 100.98% | 96.47% | 91.95% | 89.08% | 85.01% | 82.45% | 78.34% | 74.67% | 67.75% |
| | 0.40 | 98.99% | 93.76% | 89.08% | 86.77% | 82.82% | 80.23% | 76.12% | 72.03% | 65.21% |
| | 0.38 | 92.09% | 90.18% | 85.64% | 83.82% | 79.83% | 77.47% | 73.32% | 69.10% | 63.06% |
| | 0.37 | 88.63% | 86.14% | 81.94% | 79.85% | 76.32% | 74.12% | 69.84% | 65.59% | 60.41% |
| | 0.36 | 84.11% | 80.58% | 77.16% | 75.44% | 72.12% | 70.00% | 86.59% | 61.85% | 57.56% |
| | 0.35 | 77.16% | 74.23% | 71.96% | 70.67% | 67.79% | 68.03% | 82.98% | 58.05% | 53.80% |
| | 0.33 | 69.74% | 67.88% | 67.03% | 66.09% | 63.82% | 61.96% | 58.87% | 54.34% | 50.06% |
| | 0.32 | 53.96% | 62.92% | 82.84% | 81.83% | 59.50% | 57.94% | 54.98% | 50.27% | 46.09% |

Shown in Table 4 are ratios of speed of ink ejected from the ejection opening 8a when To/Tc changes in the range of 0.32 to 0.64 in the case where a ratio of $Tv_2$ to Td is varied in the range of 17% to 83% ($Tv_2$/Td=0.17 to 0.83). The ejection speed ratios are shown in percentages by setting the ejection speed when $Tv_1$/Td=$Tv_2$/Td=0.33 and To/Tc=0.50 to 1. The numerical analysis according to Table 4 was performed under the condition of $Tv_1$/Td=0.33.

Figure 13:
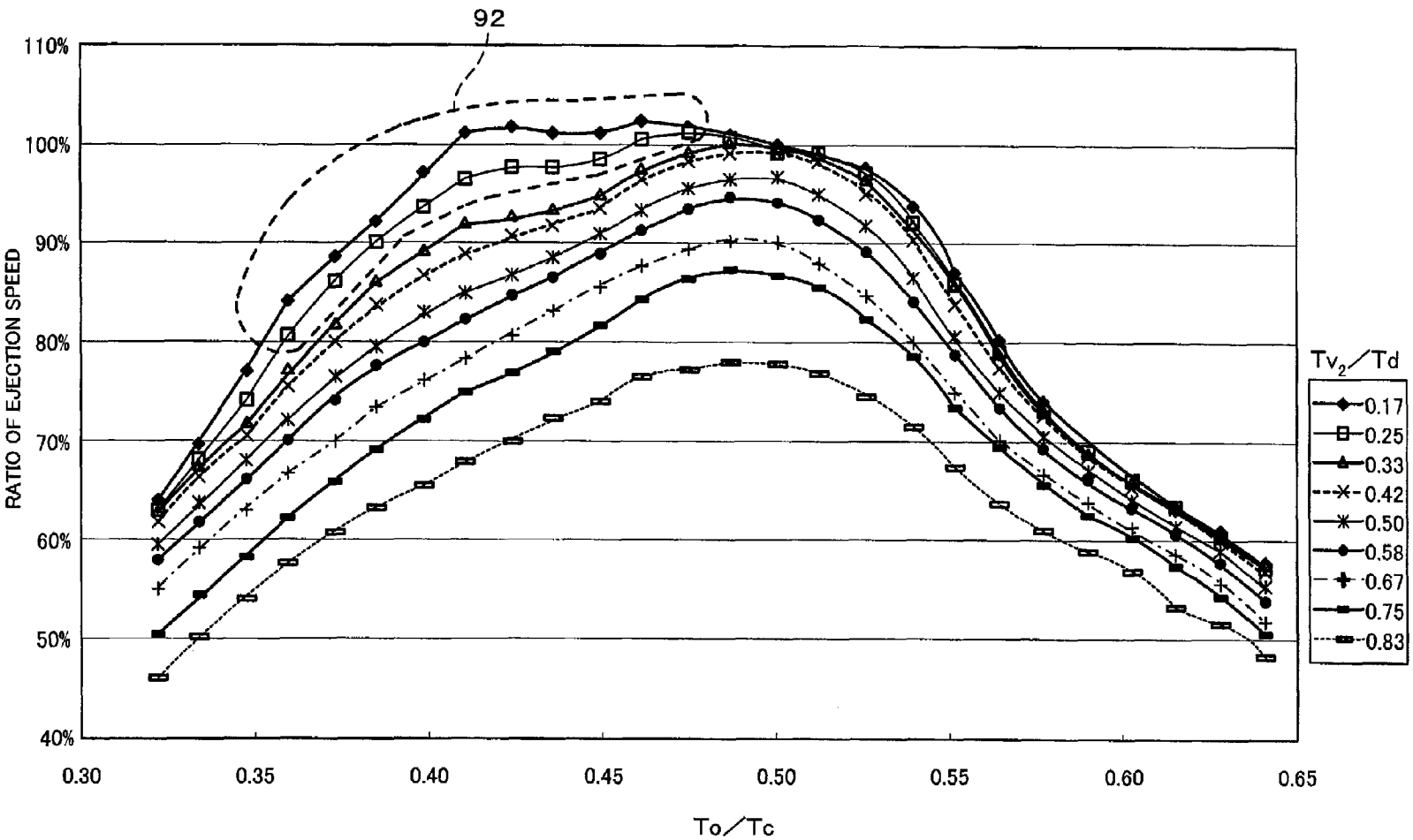
FIG. 13 is a graph showing another result of numerical analysis conducted by using the model shown in FIGS. 10A to 10C.

FIG. 13 is a graph showing the results of the numerical analysis shown in Table 4. The horizontal axis represents To/Tc, and the vertical axis represents the ratio of the ejection speed. Each of the curves shows a result per parameter $Tv_2$/Td. In the curves wherein $Tv_2$/Td is less than 0.33, i.e., the ratio of $Tv_2$ to Td is less than 33%, an extreme value of the ejection speed except for To=AL appears in the range 92 of FIG. 13 in the same manner as in the range 91 of FIG. 11. From the results, it is understood that the ratio of $Tv_2$ to Td of 33% or more is sufficient.

Therefore, it is preferable to control the piezoelectric actuator 50 so as to keep the $Tv_2$ to 33% or more of Td. With such control, the problem of unsatisfactory reproduction of images due to the occurrence of noise or variation in ink ejection speed is suppressed, as the extreme value is seldom or never appears when the ratio of $Tv_2$ to Td is 33% or more in the above analysis results as shown in FIG. 13. Such effect is achieved since the change in pressure applied by the piezoelectric actuator 50 to ink in the pressure chamber 10 is moderated due to the satisfactory increase in $Tv_2$. Thus, a pressure wave that generates the characteristic vibration hardly arises in ink filled in the first ink passage 33, so that the excitation of the characteristic vibration is suppressed.

Shown in Table 5 are results of numerical analysis performed in the simulation in the cases where $Tv_2$=0.9 $Tv_1$, $Tv_2$=$Tv_1$, and $Tv_2$=1.1 $Tv_1$, respectively. Shown in Table 5 are ratios of the ejection speed in the case where a ratio of $Tv_1$ to Td is varied in the range of 17% to 83% ($Tv_1$/Td=0.17 to 0.83). The ejection speed ratios are shown in percentages by setting an ejection speed when $Tv_1$/Td=$Tv_2$/Td=0.33 and To/Tc=0.50 to 1. The numerical analysis according to Table 5 was performed under the condition of To/Tc=0.50.

TABLE 5

| | $Tv_1$/Td | | | | | | | | |
|---|---|---|---|---|---|---|---|---|---|
| | 0.17 | 0.25 | 0.33 | 0.42 | 0.50 | 0.58 | 0.67 | 0.75 | 0.83 |
| $Tv_2$ = 0.9$Tv_1$ | 100.61% | 99.46% | 100.28% | 99.97% | 98.69% | 95.93% | 92.85% | 91.21% | 83.71% |
| $Tv_2$ = $Tv_1$ | 100.61% | 99.39% | 100.00% | 99.35% | 96.57% | 94.19% | 89.85% | 87.01% | 78.07% |
| $Tv_2$ = 1.1$Tv_1$ | 100.61% | 99.28% | 99.60% | 98.52% | 95.19% | 92.12% | 86.98% | 80.72% | 72.25% |

Figure 14:
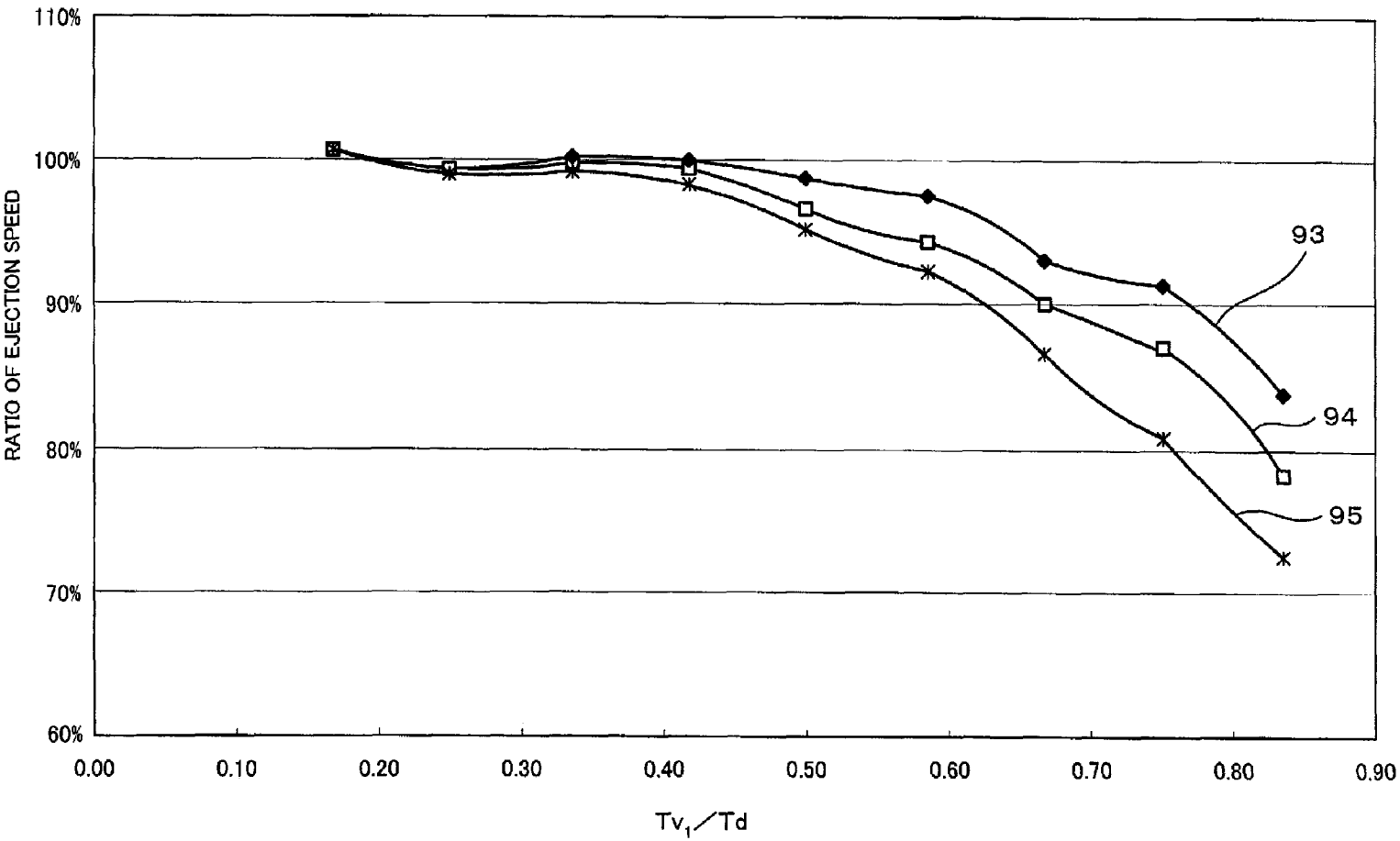
FIG. 14 is a graph showing yet another result of numerical analysis performed by using the models shown in FIGS. 10A to 10C.

FIG. 14 is a graph showing the results of the numerical analysis shown in Table 5. The horizontal axis represents the ratio of $Tv_1$ to Td, and the vertical axis represents the ratio of the ejection speed. The curves 93, 94, and 95 show the result obtained when $Tv_2$=0.9 $Tv_1$, the result obtained when $Tv_2$=$Tv_1$, and the result obtained when $Tv_2$=1.1 $Tv_1$, respectively. A relationship "the ejection speed of the curve 93 >the ejection speed of the curve 94 >the ejection speed of the curve 95" is established in almost all the range of $Tv_1$/Td as shown in FIG. 14.

Therefore, it is preferable that the relationship of $Tv_1$>$Tv_2$ is established. With such relationship, the ink ejection speed is increased irrelevant from the value of $Tv_1$ as compared to the case where $Tv_1$<$Tv_2$, and the ink ejection speed suitable for printing is ensured in the wide range of $Tv_1$/Td.

Shown in Table 6 are ratios of speed of the ink ejected from the ejection opening 8*a* in the case where $Tv_1$ and $Tv_2$ are varied. The ejection speed ratios are shown in percentages by setting an ejection speed when $Tv_1$/Td=$Tv_2$/Td=0.33 and To/Tc=0.50 to 1. The numerical analysis according to Table 6 was performed under the condition of To/Tc=0.50.

TABLE 6

| | | $Tv_1$/Td | | | | | | | | | | | | | |
|---|---|---|---|---|---|---|---|---|---|---|---|---|---|---|---|
| | | 0.34 | 0.36 | 0.38 | 0.40 | 0.42 | 0.44 | 0.46 | 0.48 | 0.50 | 0.52 | 0.54 | 0.56 | 0.58 | 0.60 |
| $Tv_2$/Td | 0.34 | 100.0% | 100.0% | 100.0% | 100.0% | 99.9% | 99.8% | 89.9% | 99.8% | 99.7% | 99.4% | 99.3% | 99.2% | 99.1% | 99.0% |
| | 0.36 | | 100.0% | 99.8% | 99.9% | 99.8% | 99.7% | 99.6% | 99.6% | 99.4% | 99.1% | 99.8% | 99.8% | 99.0% | 98.8% |
| | 0.38 | | | 99.7% | 99.7% | 99.6% | 99.5% | 99.4% | 99.4% | 99.2% | 98.8% | 99.8% | 99.8% | 98.9% | 98.7% |
| | 0.40 | | | | 99.5% | 99.4% | 99.3% | 99.2% | 98.1% | 99.0% | 98.5% | 99.7% | 99.7% | 98.7% | 98.6% |
| | 0.42 | | | | | 99.0% | 99.0% | 98.8% | 98.7% | 98.8% | 98.3% | 98.4% | 99.4% | 96.3% | 98.3% |
| | 0.44 | | | | | | 98.4% | 98.3% | 98.2% | 98.2% | 98.2% | 98.1% | 98.1% | 98.0% | 97.8% |
| | 0.46 | | | | | | | 97.6% | 97.5% | 97.5% | 97.4% | 97.3% | 97.2% | 97.2% | 97.1% |
| | 0.48 | | | | | | | | 97.0% | 97.0% | 96.8% | 96.8% | 98.7% | 96.6% | 96.5% |
| | 0.50 | | | | | | | | | 96.6% | 96.5% | 96.5% | 96.4% | 96.3% | 95.1% |
| | 0.52 | | | | | | | | | | 95.8% | 95.7% | 95.6% | 95.5% | 94.6% |
| | 0.54 | | | | | | | | | | | 94.9% | 94.8% | 94.7% | 93.9% |
| | 0.56 | | | | | | | | | | | | 94.0% | 93.9% | 93.3% |
| | 0.58 | | | | | | | | | | | | | 93.3% | 92.7% |
| | 0.60 | | | | | | | | | | | | | | 92.0% |

As shown in Table 6, the ejection speed is maintained to 98% or more of the reference value when $Tv_2$/Td≦0.44. When 0.50≦$Tv_1$/Td≦0.60, an extreme reduction in ejection speed is prevented simultaneously with maintaining the ink ejection at the most stable state.

Therefore, it is preferable to control the piezoelectric actuator 50 in such a manner that the ratio of $Tv_1$ to Td becomes 50% to 60% and the ratio of $Tv_2$ to Td becomes 33% to 44%. With such control, an extreme reduction in ejection speed is prevented simultaneously with maintaining the ink ejection at the most stable state.

Though the case of adjusting the pulse width To of the voltage pulse signal to AL has been described above, the pulse with To may be a value other than AL. As shown in FIGS. 11 and 13, in the range of To/Tc>0.5, though the influence of the characteristic vibration of ink in the first ink passage 33 is not prominent, the ratio of change of the ejection speed with respect to the pulse width To is larger than that of the case of To/Tc<0.5 regardless of the value of $Tv_1$ or $Tv_2$. In the range of To/Tc is 0.4 to 0.5, the change ratio is gradual as compared to the other ranges of To/Tc. That is, when the pulse width To is adjusted so as to keep To/TC in the range of 0.4 to 0.5, the ejection speed change ratio with respect to the pulse width To is small, i.e., the influence of the change in the pulse width To upon the ejection speed is reduced. Further, in the case where 0.33 Td≦$Tv_1$≦0.12 Tc or 0.33 Td≦$Tv_1$≦0.6 Td, 0.33 Td≦$Tv_2$≦0.44 Td, and $Tv_1$>$Tv_2$, the ejection speed is maintained to 80% or more of the reference value and the freedom of the ejection speed with respect to the pulse width To is increased by maintaining To/Tc to the range of 0.4 to 0.5. That is, the vibration of ink in the first ink passage 33 acts effectively on the ink ejection in the wide range of the pulse width To, so as to avoid an extreme change or reduction in ejection speed and to maintain the ink ejection at the most stable state.

The waveform of the voltage pulse signal is not limited to the rectangular wave insofar as the above conditions are satisfied when a voltage pulse signal corresponding to the waveform is applied to the individual electrode 35 and can be a non-rectangular wave wherein each of a trailing edge and a rising edge has an angle larger than 90 degrees as in the potential change curve of the individual electrode 35 shown in FIG. 7.

The method of setting $Tv_1$ and/or $Tv_2$ to the above numerical ranges is not limited to the adjustment of the waveform of the voltage pulse signal supplied to the individual electrode 35. For example, $Tv_1$ and/or $Tv_2$ may be set to the above numerical ranges by adjusting any one of the size and the shape of the individual electrode 35, the distance between the individual electrode 35 and the common electrode 34, and the dielectric constant of the piezoelectric layer 41.

Wave data indicating various types of basic waveforms with which $Tv_1$, $Tv_2$, and the like satisfy the above-described conditions such as $Tv_1$≧0.33 Td or $Tv_1$≦0.12 Tc when the voltage pulse signal is supplied to the individual electrode 35 may preliminary be stored in the wave data memory 103, so that the print controller 101 selects one of the basic waveforms indicated by the wave data stored in the wave data memory 103 to supply a voltage pulse signal corresponding to the selected basic waveform to the individual electrode 35.

It is understood that the problem according to this invention is raised when the characteristic vibration of the pressure generated in ink filled in the first ink passage 33 overlaps with the pressure wave reflected in the ink passage. Therefore, the problem according to this invention can occur in other components than the passage unit 4 shown in FIG. 4 which has the sub-manifold channel 5*a* and the individual ink passage 32 including the first ink passage 33, the pressure chamber 10, and the aperture 12. It is also understood that, since the problem according to this invention is raised due to the overlapping of the pressure waves generated in the ink passage as described above, the problem according to this invention is raised irrelevant from the method of pressurizing ink. Therefore, the problem according to this invention can be raised in the cases where ink is pressurized by a pressurizing actuator other than the piezoelectric actuator.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of this invention as defined in the following claims.

What is claimed is:

1. An inkjet recording apparatus comprising:

a pressurizing actuator;

a passage unit in which a pressure chamber whose volume is changed by the pressurizing actuator and an ejection opening for ejecting ink are formed, the passage unit having a first ink passage which extends from an outlet of the pressure chamber to the ejection opening; and a controller controlling the pressurizing actuator in such a manner that the pressure chamber changes from a first state where a volume of the pressure chamber is V1 to a second state where the volume is V2 which is larger than V1 and then returns from the second state to the first state to cause ink to be ejected from the ejection opening, that a time length $Tv_1$ from a time point at which the pressure chamber starts to change from the first state to the second state to a time point at which the pressure chamber is in the second state becomes 33% or more of a characteristic vibration period Td of ink filled in the first ink passage, and that the time length $Tv_1$ becomes 83% or less of the characteristic vibration period Td.

2. The inkjet recording apparatus according to claim 1, wherein:

the passage unit further comprises a common ink chamber for supplying ink to the pressure chamber and a second ink passage extending from an outlet of the common ink chamber to an inlet of the pressure chamber; and the controller controls the pressurizing actuator in such a manner that the time length $Tv_1$ becomes 12% or less of a characteristic vibration period Tc of ink filled in an individual ink passage formed of the first and the second ink passages and the pressure chamber.

3. The inkjet recording apparatus according to claim 1, wherein the controller controls the pressurizing actuator in such a manner that the time length $Tv_1$ becomes 67% or less of the characteristic vibration period Td.

4. The inkjet recording apparatus according to claim 1, wherein the controller controls the pressurizing actuator in such a manner that a time length $Tv_2$ from a time point at which the pressure chamber starts to return from the second state to the first state to a time point at which the pressure chamber returns to the first state becomes 33% or more of the characteristic vibration period Td.

5. The inkjet recording apparatus according to claim 4, wherein the controller controls the pressurizing actuator in such a manner that the time length $Tv_2$ becomes smaller than the time length $Tv_1$.

6. The inkjet recording apparatus according to claim 5, wherein the controller controls the pressurizing actuator in such a manner that the time length $Tv_1$ becomes 50% to 60% of the characteristic vibration period Td and that the time length $Tv_2$ becomes 33% to 44% of the characteristic vibration period Td.

7. The inkjet recording apparatus according to claim 1, wherein a waveform of a signal supplied to the pressurizing actuator in order to change the volume of the pressure chamber is a simple rectangular wave.

8. A method for controlling an inkjet recording apparatus, the inkjet recording apparatus including: a pressurizing actuator; and a passage unit in which a pressure chamber whose volume is changed by the pressurizing actuator and an ejection opening for ejecting ink are formed, the passage unit having a first ink passage which extends from an outlet of the pressure chamber to the ejection opening, the method comprising a step of controlling the pressurizing actuator in such a manner that the pressure chamber changes from a first state where a volume of the pressure chamber is V1 to a second state where the volume is V2 which is larger than V1 and then returns from the second state to the first state to cause ink to be ejected from the ejection opening, that a time length $Tv_1$ from a time point at which the pressure chamber starts to change from the first state to the second state to a time point at which the pressure chamber is in the second state becomes 33% or more of a characteristic vibration period Td of ink filled in the first ink passage, and that the time length $Tv_1$ becomes 83% or less of the characteristic vibration period Td.

* * * * *